US012390689B2

(12) United States Patent
Posnack et al.

(10) Patent No.: US 12,390,689 B2
(45) **Date of Patent: *Aug. 19, 2025**

(54) PERSUASIVE MOTIVATION FOR ORTHOPEDIC TREATMENT

(71) Applicant: ROM Technologies, Inc.

(72) Inventors: Daniel Posnack, Fort Lauderdale, FL (US); Peter Arn, Roxbury, CT (US); S. Adam Hacking, Nashua, NH (US); Micheal Mueller, Oil City, PA (US); Joe Guaneri, Merrick, NY (US); Jonathan Greene, Denver, CO (US)

(73) Assignee: ROM Technologies, Inc., Brookfield, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/520,137

(22) Filed: Nov. 27, 2023

(65) Prior Publication Data

US 2024/0091594 A1 Mar. 21, 2024

Related U.S. Application Data

(63) Continuation of application No. 17/075,508, filed on Oct. 20, 2020, now Pat. No. 11,826,613.
(Continued)

(51) Int. Cl.
*A63B 24/00* (2006.01)
*A63B 21/00* (2006.01)
(Continued)

(52) U.S. Cl.
CPC ..... *A63B 24/00* (2013.01); *A63B 21/00178* (2013.01); *A63B 21/00181* (2013.01);
(Continued)

(58) Field of Classification Search
None
See application file for complete search history.

(56) References Cited

U.S. PATENT DOCUMENTS 823,712 A 6/1906 Uhlmann
4,499,900 A 2/1985 Petrofsky et al.
(Continued)

FOREIGN PATENT DOCUMENTS

CA 3193419 A1 3/2022
CN 2885238 Y 4/2007
(Continued)

OTHER PUBLICATIONS

HCL Fitness, HCI Fitness PhysioTrainer Pro, 2017, retrieved on Aug. 19, 2021, 7 pages, https://www.amazon.com/HCI-Fitness-Physio Trainer-Electronically-Controlled/dp/B0759YMW78/.
(Continued)

*Primary Examiner* — Shila Jalalzadeh Abyaneh
(74) *Attorney, Agent, or Firm* — Dickinson Wright PLLC; Jonathan H. Harder; Stephen A. Mason

(57) ABSTRACT

In one embodiment, a method is disclosed. The method includes, while the patient uses the treatment apparatus, controlling, based on a treatment plan for a patient, a treatment apparatus. The method includes receiving, by a processing device, data from an electronic device, wherein the data comprises one of a position of a body part of the patient or a force exerted by the body part. The method includes storing, via the processing device, the data for the patient in a computer-readable medium. The method includes causing, via a processing device, presentation of a user interface on a patient interface. The user interface comprises an adjustment confirmation control, and the adjustment confirmation control is configured to solicit a response regarding the patient's comfort level with the one
(Continued)

of the position of the body part or the force exerted by the body part.

20 Claims, 16 Drawing Sheets

Related U.S. Application Data

(60) Provisional application No. 62/923,829, filed on Oct. 21, 2019.

(51) Int. Cl.
*A63B 22/06* (2006.01)
*A63B 71/06* (2006.01)

(52) U.S. Cl.
CPC ..... *A63B 22/0694* (2013.01); *A63B 24/0062* (2013.01); *A63B 24/0075* (2013.01); *A63B 71/0622* (2013.01); *A63B 2024/0093* (2013.01); *A63B 2071/0625* (2013.01); *A63B 2071/065* (2013.01); *A63B 2071/0655* (2013.01); *A63B 2071/0675* (2013.01)

(56) References Cited

U.S. PATENT DOCUMENTS 4,822,032 A 4/1989 Whitmore et al.
4,860,763 A 8/1989 Schminke
4,869,497 A 9/1989 Stewart et al.
4,932,650 A 6/1990 Bingham et al.
5,137,501 A 8/1992 Mertesdorf
5,161,430 A 11/1992 Febey
5,202,794 A 4/1993 Schnee et al.
5,240,417 A 8/1993 Smithson et al.
5,247,853 A 9/1993 Dalebout
5,256,117 A 10/1993 Potts et al.
D342,299 S 12/1993 Birrell et al.
5,282,748 A 2/1994 Little
5,284,131 A 2/1994 Gray
5,316,532 A 5/1994 Butler
5,318,487 A 6/1994 Golen
5,324,241 A 6/1994 Artigues et al.
5,336,147 A 8/1994 Sweeney, III
5,338,272 A 8/1994 Sweeney, III
5,356,356 A 10/1994 Hildebrandt
5,361,649 A 11/1994 Slocum, Jr.
D359,777 S 6/1995 Hildebrandt
5,429,140 A 7/1995 Burdea et al.
5,458,022 A 10/1995 Mattfeld et al.
5,487,713 A 1/1996 Butler
5,566,589 A 10/1996 Buck
5,580,338 A 12/1996 Scelta et al.
5,676,349 A 10/1997 Wilson
5,685,804 A 11/1997 Whan-Tong et al.
5,738,636 A 4/1998 Saringer et al.
5,860,941 A 1/1999 Saringer et al.
5,950,813 A 9/1999 Hoskins et al.
6,007,459 A 12/1999 Burgess
D421,075 S 2/2000 Hildebrandt
6,053,847 A 4/2000 Stearns et al.
6,077,201 A 6/2000 Cheng
6,102,834 A 8/2000 Chen
6,110,130 A 8/2000 Kramer
6,155,958 A 12/2000 Goldberg
6,162,189 A 12/2000 Girone et al.
6,182,029 B1 1/2001 Friedman
D438,580 S 3/2001 Shaw
6,253,638 B1 7/2001 Bermudez
6,267,735 B1 * 7/2001 Blanchard ..... A61H 1/024 601/33
6,273,863 B1 8/2001 Avni et al.
D450,100 S 11/2001 Hsu
D450,101 S 11/2001 Hsu
D451,972 S 12/2001 Easley
D452,285 S 12/2001 Easley
D454,605 S 3/2002 Lee
6,371,891 B1 4/2002 Speas
D459,776 S 7/2002 Lee
6,413,190 B1 7/2002 Wood et al.
6,430,436 B1 8/2002 Richter
6,436,058 B1 * 8/2002 Krahner ..... A63B 21/4025 600/587
6,450,923 B1 9/2002 Vatti
6,474,193 B1 11/2002 Farney
6,491,649 B1 12/2002 Ombrellaro
6,514,085 B2 2/2003 Slattery et al.
6,535,861 B1 3/2003 OConnor et al.
6,543,309 B2 4/2003 Heim
6,589,139 B1 7/2003 Butterworth
6,601,016 B1 7/2003 Brown et al.
6,602,191 B2 8/2003 Quy
6,613,000 B1 9/2003 Reinkensmeyer et al.
6,626,800 B1 9/2003 Casler
6,626,805 B1 9/2003 Lightbody
6,640,122 B2 10/2003 Manoli
6,640,662 B1 11/2003 Baxter
6,652,425 B1 11/2003 Martin et al.
6,820,517 B1 11/2004 Farney
6,865,969 B2 3/2005 Stevens
6,890,312 B1 5/2005 Priester et al.
6,895,834 B1 5/2005 Baatz
6,902,513 B1 6/2005 McClure
7,058,453 B2 6/2006 Nelson et al.
7,063,643 B2 6/2006 Arai
7,156,665 B1 1/2007 OConnor et al.
7,156,780 B1 1/2007 Fuchs et al.
7,169,085 B1 1/2007 Killin et al.
7,204,788 B2 4/2007 Andrews
7,209,886 B2 4/2007 Kimmel
7,226,394 B2 6/2007 Johnson
RE39,904 E 10/2007 Lee
7,406,003 B2 7/2008 Burkhardt et al.
7,507,188 B2 3/2009 Nurre
7,594,879 B2 9/2009 Johnson
7,628,730 B1 12/2009 Watterson et al.
D610,635 S 2/2010 Hildebrandt
7,778,851 B2 8/2010 Schoenberg et al.
7,809,601 B2 10/2010 Shaya et al.
7,815,551 B2 10/2010 Merli
7,833,135 B2 11/2010 Radow et al.
7,837,472 B1 11/2010 Elsmore et al.
7,890,342 B1 2/2011 Yruko
7,955,219 B2 6/2011 Birrell et al.
7,969,315 B1 6/2011 Ross et al.
7,988,599 B2 8/2011 Ainsworth et al.
8,012,107 B2 9/2011 Einav et al.
8,021,270 B2 9/2011 D'Eredita
8,038,578 B2 10/2011 Olrik et al.
8,079,937 B2 12/2011 Bedell
8,113,991 B2 2/2012 Kutliroff
8,172,724 B2 5/2012 Solomon
8,177,732 B2 5/2012 Einav et al.
8,287,434 B2 10/2012 Zavadsky et al.
8,298,123 B2 10/2012 Hickman
8,371,990 B2 2/2013 Shea
8,419,593 B2 4/2013 Ainsworth et al.
8,465,398 B2 6/2013 Lee et al.
8,506,458 B2 8/2013 Dugan
8,515,777 B1 8/2013 Rajasenan
8,540,515 B2 9/2013 Williams et al.
8,540,516 B2 9/2013 Williams et al.
8,556,778 B1 10/2013 Dugan
8,607,465 B1 12/2013 Edwards
8,613,689 B2 12/2013 Dyer et al.
8,615,529 B2 12/2013 Reiner
8,672,812 B2 3/2014 Dugan
8,751,264 B2 6/2014 Beraja et al.
8,784,273 B2 7/2014 Dugan
8,818,496 B2 8/2014 Dziubinski et al.
8,823,448 B1 9/2014 Shen
8,845,493 B2 9/2014 Watterson et al.
8,849,681 B2 9/2014 Hargrove et al.
8,864,628 B2 10/2014 Boyette et al.

(56) References Cited

U.S. PATENT DOCUMENTS

| | | | |
|---|---|---|---|
| 8,893,287 | B2 | 11/2014 | Gjonej et al. |
| 8,905,925 | B2 | 12/2014 | Beck et al. |
| 8,911,327 | B1 | 12/2014 | Boyette |
| 8,979,711 | B2 | 3/2015 | Dugan |
| 9,004,598 | B2 | 4/2015 | Weber |
| 9,044,630 | B1 | 6/2015 | Lampert et al. |
| 9,167,281 | B2 | 10/2015 | Petrov et al. |
| D744,050 | S | 11/2015 | Colburn |
| 9,177,106 | B2 | 11/2015 | Smith et al. |
| 9,248,071 | B1 | 2/2016 | Brenda |
| 9,256,711 | B2 | 2/2016 | Horseman |
| 9,272,091 | B2 | 3/2016 | Skelton |
| 9,272,185 | B2 | 3/2016 | Dugan |
| 9,283,434 | B1 | 3/2016 | Wu |
| 9,295,878 | B2 | 3/2016 | Corbalis et al. |
| 9,311,789 | B1 | 4/2016 | Gwin |
| 9,312,907 | B2 | 4/2016 | Auchinleck et al. |
| 9,367,668 | B2 | 6/2016 | Flynt et al. |
| 9,409,054 | B2 | 8/2016 | Dugan |
| 9,420,956 | B2 | 8/2016 | Gopalakrishnan et al. |
| 9,443,205 | B2 | 9/2016 | Wall |
| 9,474,935 | B2 | 10/2016 | Abbondanza et al. |
| 9,480,873 | B2 | 11/2016 | Chuang |
| 9,481,428 | B2 | 11/2016 | Gros |
| 9,514,277 | B2 | 12/2016 | Hassing et al. |
| 9,566,472 | B2 | 2/2017 | Dugan |
| 9,579,056 | B2 | 2/2017 | Rosenbek et al. |
| 9,629,558 | B2 | 4/2017 | Yuen et al. |
| 9,640,057 | B1 | 5/2017 | Ross |
| 9,707,147 | B2 | 7/2017 | Levital et al. |
| 9,713,744 | B2 | 7/2017 | Suzuki |
| D794,142 | S | 8/2017 | Zhou |
| 9,717,947 | B2 | 8/2017 | Lin |
| 9,737,761 | B1 | 8/2017 | Govindarajan |
| 9,757,612 | B2 | 9/2017 | Weber |
| 9,782,621 | B2 | 10/2017 | Chiang et al. |
| 9,802,076 | B2 | 10/2017 | Murray et al. |
| 9,802,081 | B2 | 10/2017 | Ridgel et al. |
| 9,813,239 | B2 | 11/2017 | Chee et al. |
| 9,826,908 | B2 | 11/2017 | Wu |
| 9,827,445 | B2 | 11/2017 | Marcos et al. |
| 9,849,337 | B2 | 12/2017 | Roman et al. |
| 9,868,028 | B2 | 1/2018 | Shin |
| 9,872,087 | B2 | 1/2018 | DelloStritto et al. |
| 9,872,637 | B2 | 1/2018 | Kording et al. |
| 9,914,053 | B2 | 3/2018 | Dugan |
| 9,919,198 | B2 | 3/2018 | Romeo et al. |
| 9,937,382 | B2 | 4/2018 | Dugan |
| 9,939,784 | B1 | 4/2018 | Berardinelli |
| 9,974,478 | B1 | 5/2018 | Brokaw |
| 9,977,587 | B2 | 5/2018 | Mountain |
| 9,993,181 | B2 | 6/2018 | Ross |
| 9,997,082 | B2 | 6/2018 | Kaleal |
| 10,004,946 | B2 | 6/2018 | Ross |
| 10,026,052 | B2 | 7/2018 | Brown et al. |
| D826,349 | S | 8/2018 | Oblamski |
| 10,055,550 | B2 | 8/2018 | Goetz |
| 10,058,473 | B2 | 8/2018 | Oshima et al. |
| 10,074,148 | B2 | 9/2018 | Cashman et al. |
| 10,089,443 | B2 | 10/2018 | Miller et al. |
| 10,111,643 | B2 | 10/2018 | Shulhauser et al. |
| 10,130,311 | B1 | 11/2018 | De Sapio et al. |
| 10,137,328 | B2 | 11/2018 | Baudhuin |
| 10,143,395 | B2 | 12/2018 | Chakravarthy et al. |
| 10,155,134 | B2 | 12/2018 | Dugan |
| 10,159,872 | B2 | 12/2018 | Sasaki et al. |
| 10,173,094 | B2 | 1/2019 | Gomberg et al. |
| 10,173,095 | B2 | 1/2019 | Gomberg et al. |
| 10,173,096 | B2 | 1/2019 | Gomberg et al. |
| 10,173,097 | B2 | 1/2019 | Gomberg et al. |
| 10,182,726 | B2 | 1/2019 | Ahmed et al. |
| 10,198,928 | B1 | 2/2019 | Ross et al. |
| 10,226,663 | B2 | 3/2019 | Gomberg et al. |
| 10,231,664 | B2 | 3/2019 | Ganesh |
| 10,244,990 | B2 | 4/2019 | Hu et al. |
| 10,258,823 | B2 | 4/2019 | Cole |
| 10,322,315 | B2 | 6/2019 | Foley et al. |
| 10,325,070 | B2 | 6/2019 | Beale et al. |
| 10,327,697 | B1 | 6/2019 | Stein et al. |
| 10,362,940 | B2 | 7/2019 | Tran |
| 10,369,021 | B2 | 8/2019 | Zoss et al. |
| 10,380,866 | B1 | 8/2019 | Ross et al. |
| 10,413,222 | B1 | 9/2019 | Kayyali |
| 10,413,238 | B1 | 9/2019 | Cooper |
| 10,424,033 | B2 | 9/2019 | Romeo |
| 10,430,552 | B2 | 10/2019 | Mihai |
| D866,957 | S | 11/2019 | Ross et al. |
| 10,468,131 | B2 | 11/2019 | Macoviak et al. |
| 10,475,323 | B1 | 11/2019 | Ross |
| 10,475,537 | B2 | 11/2019 | Purdie et al. |
| 10,492,977 | B2 | 12/2019 | Kapure et al. |
| 10,507,358 | B2 | 12/2019 | Kinnunen et al. |
| 10,542,914 | B2 | 1/2020 | Forth et al. |
| 10,546,467 | B1 | 1/2020 | Luciano, Jr. et al. |
| 10,569,122 | B2 | 2/2020 | Johnson |
| 10,572,626 | B2 | 2/2020 | Balram |
| 10,576,331 | B2 | 3/2020 | Kuo |
| 10,581,896 | B2 | 3/2020 | Nachenberg |
| 10,625,114 | B2 | 4/2020 | Ercanbrack |
| 10,646,746 | B1 | 5/2020 | Gomberg et al. |
| 10,660,534 | B2 | 5/2020 | Lee et al. |
| 10,678,890 | B2 | 6/2020 | Bitran et al. |
| 10,685,092 | B2 | 6/2020 | Paparella et al. |
| 10,741,285 | B2 | 8/2020 | Moturu |
| 10,777,200 | B2 | 9/2020 | Will et al. |
| D899,605 | S | 10/2020 | Ross et al. |
| 10,792,495 | B2 | 10/2020 | Izvorski et al. |
| 10,814,170 | B2 | 10/2020 | Wang et al. |
| 10,857,426 | B1 | 12/2020 | Neumann |
| 10,867,695 | B2 | 12/2020 | Neagle |
| 10,874,905 | B2 | 12/2020 | Belson et al. |
| D907,143 | S | 1/2021 | Ach et al. |
| 10,881,911 | B2 | 1/2021 | Kwon et al. |
| 10,918,332 | B2 | 2/2021 | Belson et al. |
| 10,931,643 | B1 | 2/2021 | Neumann |
| 10,987,176 | B2 | 4/2021 | Poltaretskyi et al. |
| 10,991,463 | B2 | 4/2021 | Kutzko et al. |
| 11,000,735 | B2 | 5/2021 | Orady et al. |
| 11,045,709 | B2 | 6/2021 | Putnam |
| 11,065,170 | B2 | 7/2021 | Yang et al. |
| 11,065,527 | B2 | 7/2021 | Putnam |
| 11,069,436 | B2 | 7/2021 | Mason et al. |
| 11,071,597 | B2 | 7/2021 | Posnack et al. |
| 11,075,000 | B2 | 7/2021 | Mason et al. |
| D928,635 | S | 8/2021 | Hacking et al. |
| 11,087,865 | B2 | 8/2021 | Mason et al. |
| 11,094,400 | B2 | 8/2021 | Riley et al. |
| 11,101,028 | B2 | 8/2021 | Mason et al. |
| 11,107,591 | B1 | 8/2021 | Mason |
| 11,139,060 | B2 | 10/2021 | Mason et al. |
| 11,185,735 | B2 | 11/2021 | Arn et al. |
| 11,185,738 | B1 | 11/2021 | McKirdy et al. |
| D939,096 | S | 12/2021 | Lee |
| D939,644 | S | 12/2021 | Ach et al. |
| D940,797 | S | 1/2022 | Ach et al. |
| D940,891 | S | 1/2022 | Lee |
| 11,229,727 | B2 | 1/2022 | Tatonetti |
| 11,229,788 | B1 | 1/2022 | John |
| 11,265,234 | B2 | 3/2022 | Guaneri et al. |
| 11,270,795 | B2 | 3/2022 | Mason et al. |
| 11,272,879 | B2 | 3/2022 | Wiedenhoefer et al. |
| 11,278,766 | B2 | 3/2022 | Lee |
| 11,282,599 | B2 | 3/2022 | Mason et al. |
| 11,282,604 | B2 | 3/2022 | Mason et al. |
| 11,282,608 | B2 | 3/2022 | Mason et al. |
| 11,284,797 | B2 | 3/2022 | Mason et al. |
| D948,639 | S | 4/2022 | Ach et al. |
| 11,295,848 | B2 | 4/2022 | Mason et al. |
| 11,298,284 | B2 | 4/2022 | Bayerlein |
| 11,309,085 | B2 | 4/2022 | Mason et al. |
| 11,317,975 | B2 | 5/2022 | Mason et al. |
| 11,325,005 | B2 | 5/2022 | Mason et al. |
| 11,328,807 | B2 | 5/2022 | Mason et al. |
| 11,337,648 | B2 | 5/2022 | Mason |

(56) References Cited

U.S. PATENT DOCUMENTS 11,347,829 B1 5/2022 Sclar et al.
11,348,683 B2 5/2022 Guaneri et al.
11,370,328 B2 6/2022 Main
11,376,470 B2 7/2022 Weldemariam
11,404,150 B2 8/2022 Guaneri et al.
11,410,768 B2 8/2022 Mason et al.
11,422,841 B2 8/2022 Jeong
11,437,137 B1 9/2022 Harris
11,495,355 B2 11/2022 McNutt et al.
11,508,258 B2 11/2022 Nakashima et al.
11,524,210 B2 12/2022 Kim et al.
11,527,326 B2 12/2022 McNair et al.
11,532,402 B2 12/2022 Farley et al.
11,534,654 B2 12/2022 Silcock et al.
D976,339 S 1/2023 Li
11,553,969 B1 1/2023 Lang et al.
11,621,067 B1 4/2023 Nolan
11,636,944 B2 4/2023 Hanrahan et al.
11,654,327 B2 5/2023 Phillips et al.
11,663,673 B2 5/2023 Pyles
11,673,024 B2 6/2023 Omid-Zohoor
11,701,548 B2 7/2023 Posnack et al.
11,776,676 B2 10/2023 Savolainen
11,944,579 B2 4/2024 Sankai
11,957,960 B2 4/2024 Bissonnette et al.
12,004,871 B1 6/2024 Fazeli
12,057,210 B2 8/2024 Akinola et al.
12,205,704 B2 1/2025 Hosoi et al.
2001/0044573 A1 11/2001 Manoli
2002/0010596 A1 1/2002 Matory
2002/0072452 A1 6/2002 Torkelson
2002/0143279 A1 10/2002 Porter et al.
2002/0160883 A1 10/2002 Dugan
2002/0183599 A1 12/2002 Castellanos
2003/0013072 A1 1/2003 Thomas
2003/0036683 A1 2/2003 Kehr et al.
2003/0064860 A1 4/2003 Yamashita et al.
2003/0064863 A1 4/2003 Chen
2003/0083596 A1 5/2003 Kramer et al.
2003/0092536 A1 5/2003 Romanelli et al.
2003/0181832 A1 9/2003 Carnahan et al.
2004/0072652 A1 4/2004 Alessandri et al.
2004/0102931 A1 5/2004 Ellis et al.
2004/0106502 A1 6/2004 Sher
2004/0147969 A1 7/2004 Mann et al.
2004/0172093 A1 9/2004 Rummerfield
2004/0194572 A1 10/2004 Kim
2004/0197727 A1 10/2004 Sachdeva et al.
2004/0204959 A1 10/2004 Moreano et al.
2005/0015118 A1 1/2005 Davis et al.
2005/0020411 A1 1/2005 Andrews
2005/0043153 A1 2/2005 Krietzman
2005/0049122 A1 3/2005 Vallone et al.
2005/0085346 A1 4/2005 Johnson
2005/0085353 A1 4/2005 Johnson
2005/0115561 A1 6/2005 Stahmann
2005/0143641 A1 6/2005 Tashiro
2005/0274220 A1 12/2005 Reboullet
2006/0003871 A1 1/2006 Houghton et al.
2006/0046905 A1 3/2006 Doody et al.
2006/0058648 A1 3/2006 Meier
2006/0064136 A1 3/2006 Wang
2006/0064329 A1 3/2006 Abolfathi et al.
2006/0129432 A1 6/2006 Choi et al.
2006/0199700 A1 9/2006 LaStayo et al.
2006/0247095 A1 11/2006 Rummerfield
2006/0277074 A1 12/2006 Einav
2007/0042868 A1 2/2007 Fisher et al.
2007/0118389 A1 5/2007 Shipon
2007/0137307 A1 6/2007 Gruben et al.
2007/0173392 A1 7/2007 Stanford
2007/0184414 A1 8/2007 Perez
2007/0194939 A1 8/2007 Alvarez et al.
2007/0219059 A1 9/2007 Schwartz
2007/0271065 A1 11/2007 Gupta et al.
2007/0287597 A1 12/2007 Cameron
2008/0021834 A1 1/2008 Holla et al.
2008/0077619 A1 3/2008 Gilley et al.
2008/0082356 A1 4/2008 Friedlander et al.
2008/0096726 A1* 4/2008 Riley ..... A63B 24/0087 482/8
2008/0153592 A1 6/2008 James-Herbert
2008/0161166 A1 7/2008 Lo
2008/0161733 A1 7/2008 Einav et al.
2008/0183500 A1 7/2008 Banigan
2008/0281633 A1 11/2008 Burdea et al.
2008/0300914 A1 12/2008 Karkanias et al.
2008/0312040 A1* 12/2008 Ochi ..... A63B 23/0405 600/587
2009/0011907 A1 1/2009 Radow et al.
2009/0037334 A1 2/2009 Hsu
2009/0058635 A1 3/2009 LaLonde et al.
2009/0070138 A1 3/2009 Langheier et al.
2009/0211395 A1 8/2009 Mule
2009/0270227 A1 10/2009 Ashby et al.
2009/0287503 A1 11/2009 Angell et al.
2009/0299766 A1 12/2009 Friedlander et al.
2010/0048358 A1 2/2010 Tchao et al.
2010/0062818 A1 3/2010 Haughay, Jr.
2010/0076786 A1 3/2010 Dalton et al.
2010/0121160 A1 5/2010 Stark et al.
2010/0173747 A1 7/2010 Chen et al.
2010/0216168 A1 8/2010 Heinzman et al.
2010/0234184 A1 9/2010 Le Page et al.
2010/0248899 A1 9/2010 Bedell et al.
2010/0248905 A1 9/2010 Lu
2010/0262052 A1 10/2010 Lunau et al.
2010/0268304 A1 10/2010 Matos
2010/0298102 A1 11/2010 Bosecker et al.
2010/0326207 A1 12/2010 Topel
2011/0010188 A1 1/2011 Yoshikawa et al.
2011/0047108 A1 2/2011 Chakrabarty et al.
2011/0082007 A1 4/2011 Birrell
2011/0087137 A1 4/2011 Hanoun
2011/0119212 A1 5/2011 De Bruin et al.
2011/0172059 A1 7/2011 Watterson et al.
2011/0195819 A1 8/2011 Shaw et al.
2011/0218814 A1 9/2011 Coats
2011/0275483 A1 11/2011 Dugan
2011/0281249 A1 11/2011 Gammell et al.
2011/0306846 A1 12/2011 Osorio
2012/0041771 A1 2/2012 Cosentino et al.
2012/0065987 A1 3/2012 Farooq et al.
2012/0116258 A1 5/2012 Lee
2012/0130196 A1 5/2012 Jain et al.
2012/0130197 A1 5/2012 Kugler et al.
2012/0167709 A1 7/2012 Chen et al.
2012/0183939 A1 7/2012 Aragones et al.
2012/0190502 A1 7/2012 Paulus et al.
2012/0232438 A1 9/2012 Cataldi et al.
2012/0259648 A1 10/2012 Mallon et al.
2012/0259649 A1 10/2012 Mallon et al.
2012/0278759 A1 11/2012 Curl et al.
2012/0295240 A1 11/2012 Walker et al.
2012/0296455 A1 11/2012 Ohnemus et al.
2012/0310667 A1 12/2012 Altman et al.
2013/0066647 A1 3/2013 Andrie
2013/0108594 A1 5/2013 Martin-Rendon et al.
2013/0110545 A1 5/2013 Smallwood
2013/0123071 A1 5/2013 Rhea
2013/0123667 A1 5/2013 Komatireddy et al.
2013/0137550 A1 5/2013 Skinner et al.
2013/0137552 A1 5/2013 Kemp et al.
2013/0158368 A1 6/2013 Pacione
2013/0165195 A1 6/2013 Watterson
2013/0178334 A1 7/2013 Brammer
2013/0211281 A1 8/2013 Ross et al.
2013/0253943 A1 9/2013 Lee et al.
2013/0274069 A1 10/2013 Watterson et al.
2013/0296987 A1 11/2013 Rogers et al.
2013/0318027 A1 11/2013 Almogy et al.
2013/0332616 A1 12/2013 Landwehr
2013/0345025 A1 12/2013 van der Merwe
2014/0006042 A1 1/2014 Keefe et al.

(56) References Cited

U.S. PATENT DOCUMENTS

2014/0011640 A1 1/2014 Dugan
2014/0031174 A1 1/2014 Huang
2014/0062900 A1 3/2014 Kaula et al.
2014/0073486 A1 3/2014 Ahmed et al.
2014/0074179 A1 3/2014 Heldman et al.
2014/0089836 A1 3/2014 Damani et al.
2014/0108035 A1 4/2014 Akbay
2014/0113261 A1* 4/2014 Akiba ..... G09B 19/00 434/247
2014/0113768 A1 4/2014 Lin et al.
2014/0135173 A1 5/2014 Watterson
2014/0155129 A1 6/2014 Dugan
2014/0163439 A1 6/2014 Uryash et al.
2014/0172442 A1 6/2014 Broderick
2014/0172460 A1 6/2014 Kohli
2014/0172514 A1 6/2014 Schumann et al.
2014/0188009 A1 7/2014 Lange et al.
2014/0194250 A1 7/2014 Reich et al.
2014/0194251 A1 7/2014 Reich et al.
2014/0200414 A1 7/2014 Osorio
2014/0207264 A1 7/2014 Quy
2014/0207486 A1 7/2014 Carty et al.
2014/0228649 A1 8/2014 Rayner et al.
2014/0246499 A1 9/2014 Proud et al.
2014/0256511 A1 9/2014 Smith
2014/0257837 A1 9/2014 Walker et al.
2014/0274565 A1 9/2014 Boyette et al.
2014/0274622 A1 9/2014 Leonhard
2014/0303540 A1 10/2014 Baym
2014/0309083 A1 10/2014 Dugan
2014/0322686 A1 10/2014 Kang
2014/0347265 A1 11/2014 Aimone et al.
2014/0371816 A1 12/2014 Matos
2014/0372133 A1 12/2014 Austrum et al.
2015/0025816 A1 1/2015 Ross
2015/0045700 A1 2/2015 Cavanagh et al.
2015/0046192 A1 2/2015 Raduchel
2015/0051721 A1 2/2015 Cheng
2015/0065213 A1 3/2015 Dugan
2015/0073814 A1 3/2015 Linebaugh
2015/0088544 A1 3/2015 Goldberg
2015/0094192 A1 4/2015 Skwortsow et al.
2015/0099458 A1 4/2015 Weisner et al.
2015/0099952 A1 4/2015 Lain et al.
2015/0111644 A1 4/2015 Larson
2015/0112230 A1 4/2015 Iglesias
2015/0112702 A1 4/2015 Joao et al.
2015/0130830 A1 5/2015 Nagasaki
2015/0141200 A1 5/2015 Murray et al.
2015/0142142 A1 5/2015 Aguilera et al.
2015/0149217 A1 5/2015 Kaburagi
2015/0151162 A1 6/2015 Dugan
2015/0157938 A1 6/2015 Domansky et al.
2015/0161331 A1 6/2015 Oleynik
2015/0161876 A1 6/2015 Castillo
2015/0174446 A1 6/2015 Chiang
2015/0196804 A1 7/2015 Koduri
2015/0196805 A1 7/2015 Koduri
2015/0199494 A1 7/2015 Koduri
2015/0217056 A1 8/2015 Kadavy et al.
2015/0251074 A1 9/2015 Ahmed et al.
2015/0257679 A1 9/2015 Ross
2015/0265209 A1 9/2015 Zhang
2015/0290061 A1 10/2015 Stafford et al.
2015/0331997 A1 11/2015 Joao
2015/0335950 A1 11/2015 Eder
2015/0335951 A1 11/2015 Eder
2015/0339442 A1 11/2015 Oleynik
2015/0341812 A1 11/2015 Dion et al.
2015/0351664 A1 12/2015 Ross
2015/0351665 A1 12/2015 Ross
2015/0360069 A1 12/2015 Marti et al.
2015/0379232 A1 12/2015 Mainwaring et al.
2015/0379430 A1 12/2015 Dirac et al.
2016/0004820 A1 1/2016 Moore
2016/0007885 A1 1/2016 Basta
2016/0015995 A1 1/2016 Leung et al.
2016/0023081 A1 1/2016 Popa-Simil et al.
2016/0045170 A1 2/2016 Migita
2016/0086500 A1 3/2016 Kaleal, III
2016/0096073 A1 4/2016 Rahman et al.
2016/0117471 A1 4/2016 Belt et al.
2016/0132643 A1 5/2016 Radhakrishna et al.
2016/0140319 A1 5/2016 Stark
2016/0143593 A1 5/2016 Fu et al.
2016/0151670 A1 6/2016 Dugan
2016/0158534 A1 6/2016 Guarraia et al.
2016/0166833 A1 6/2016 Bum
2016/0166881 A1 6/2016 Ridgel et al.
2016/0193306 A1 7/2016 Rabovsky et al.
2016/0197918 A1 7/2016 Turgeman et al.
2016/0213924 A1 7/2016 Coleman
2016/0250519 A1 9/2016 Watterson
2016/0275259 A1 9/2016 Nolan et al.
2016/0287166 A1 10/2016 Tran
2016/0302666 A1 10/2016 Shaya
2016/0302721 A1 10/2016 Wiedenhoefer et al.
2016/0317869 A1 11/2016 Dugan
2016/0322078 A1 11/2016 Bose et al.
2016/0325140 A1 11/2016 Wu
2016/0332028 A1 11/2016 Melnik
2016/0345841 A1 12/2016 Jang et al.
2016/0354636 A1 12/2016 Jang
2016/0361025 A1 12/2016 Reicher et al.
2016/0361597 A1* 12/2016 Cole ..... A63B 23/03583
2016/0373477 A1 12/2016 Moyle
2017/0004260 A1 1/2017 Moturu et al.
2017/0011179 A1 1/2017 Arshad et al.
2017/0032092 A1 2/2017 Mink et al.
2017/0033375 A1 2/2017 Ohmori et al.
2017/0042467 A1 2/2017 Herr et al.
2017/0046488 A1 2/2017 Pereira
2017/0065851 A1 3/2017 Deluca et al.
2017/0080320 A1 3/2017 Smith
2017/0091422 A1 3/2017 Kumar et al.
2017/0095670 A1 4/2017 Ghaffari et al.
2017/0095692 A1 4/2017 Chang et al.
2017/0095693 A1 4/2017 Chang et al.
2017/0100637 A1 4/2017 Princen et al.
2017/0106242 A1 4/2017 Dugan
2017/0113092 A1 4/2017 Johnson
2017/0128769 A1 5/2017 Long et al.
2017/0132947 A1* 5/2017 Maeda ..... G05G 9/047
2017/0136296 A1 5/2017 Barrera et al.
2017/0136298 A1 5/2017 Bae
2017/0143261 A1 5/2017 Wiedenhoefer et al.
2017/0147752 A1 5/2017 Toru
2017/0147789 A1 5/2017 Wiedenhoefer et al.
2017/0148297 A1 5/2017 Ross
2017/0168555 A1 6/2017 Munoz et al.
2017/0181698 A1 6/2017 Wiedenhoefer et al.
2017/0190052 A1 7/2017 Jaekel et al.
2017/0202724 A1 7/2017 De Rossi
2017/0209766 A1 7/2017 Riley et al.
2017/0220751 A1 8/2017 Davis
2017/0228517 A1 8/2017 Saliman et al.
2017/0235882 A1 8/2017 Orlov et al.
2017/0235906 A1 8/2017 Dorris et al.
2017/0243028 A1 8/2017 LaFever et al.
2017/0258370 A1 9/2017 Plotnik-Peleg et al.
2017/0262604 A1 9/2017 Francois
2017/0265800 A1 9/2017 Auchinleck et al.
2017/0266501 A1 9/2017 Sanders et al.
2017/0270260 A1 9/2017 Shetty
2017/0278209 A1 9/2017 Olsen et al.
2017/0282015 A1 10/2017 Wicks et al.
2017/0283508 A1 10/2017 Demopulos et al.
2017/0286621 A1 10/2017 Cox
2017/0296861 A1 10/2017 Burkinshaw
2017/0300654 A1 10/2017 Stein et al.
2017/0304024 A1 10/2017 Nobrega
2017/0312614 A1 11/2017 Tran et al.
2017/0323481 A1 11/2017 Tran et al.
2017/0329917 A1 11/2017 McRaith et al.

(56) References Cited

U.S. PATENT DOCUMENTS

2017/0329933 A1 11/2017 Brust
2017/0333755 A1 11/2017 Rider
2017/0337033 A1 11/2017 Duyan et al.
2017/0337334 A1 11/2017 Stanczak
2017/0344726 A1 11/2017 Duffy et al.
2017/0347923 A1 12/2017 Roh
2017/0360586 A1 12/2017 Dempers et al.
2017/0368413 A1 12/2017 Shavit
2018/0017806 A1 1/2018 Wang et al.
2018/0036591 A1 2/2018 King et al.
2018/0036593 A1 2/2018 Ridgel et al.
2018/0052962 A1 2/2018 Van Der Koijk et al.
2018/0056104 A1 3/2018 Cromie et al.
2018/0056130 A1 3/2018 Bitran et al.
2018/0060494 A1 3/2018 Dias et al.
2018/0070864 A1 3/2018 Schuster
2018/0071565 A1 3/2018 Gomberg et al.
2018/0071566 A1 3/2018 Gomberg et al.
2018/0071569 A1 3/2018 Gomberg et al.
2018/0071570 A1 3/2018 Gomberg et al.
2018/0071571 A1 3/2018 Gomberg et al.
2018/0071572 A1 3/2018 Gomberg et al.
2018/0075205 A1 3/2018 Moturu et al.
2018/0078843 A1 3/2018 Tran et al.
2018/0085615 A1 3/2018 Astolfi et al.
2018/0089385 A1 3/2018 Gupta
2018/0096111 A1 4/2018 Wells et al.
2018/0099178 A1 4/2018 Schaefer et al.
2018/0102190 A1 4/2018 Hogue et al.
2018/0103859 A1 4/2018 Provenzano
2018/0113985 A1 4/2018 Gandy et al.
2018/0116741 A1 5/2018 Garcia Kilroy et al.
2018/0117417 A1 5/2018 Davis
2018/0130555 A1 5/2018 Chronis et al.
2018/0140927 A1 5/2018 Kito
2018/0146870 A1 5/2018 Shemesh
2018/0177612 A1 6/2018 Trabish et al.
2018/0178061 A1 6/2018 O'Larte et al.
2018/0199855 A1 7/2018 Odame et al.
2018/0200577 A1 7/2018 Dugan
2018/0220935 A1 8/2018 Tadano et al.
2018/0228682 A1 8/2018 Bayerlein et al.
2018/0232492 A1 8/2018 Al-Alul et al.
2018/0236307 A1 8/2018 Hyde et al.
2018/0240552 A1 8/2018 Tuyl et al.
2018/0253991 A1 9/2018 Tang et al.
2018/0255110 A1 9/2018 Dowlatkhah et al.
2018/0256079 A1 9/2018 Yang et al.
2018/0263530 A1 9/2018 Jung
2018/0263535 A1 9/2018 Cramer
2018/0263552 A1 9/2018 Graman et al.
2018/0264312 A1 9/2018 Pompile et al.
2018/0271432 A1 9/2018 Auchinleck et al.
2018/0272184 A1 9/2018 Vassilaros et al.
2018/0280784 A1 10/2018 Romeo et al.
2018/0290017 A1 10/2018 Fung
2018/0296143 A1 10/2018 Anderson et al.
2018/0296157 A1 10/2018 Bleich et al.
2018/0318122 A1 11/2018 LeCursi et al.
2018/0326243 A1 11/2018 Badi et al.
2018/0330058 A1 11/2018 Bates
2018/0330810 A1 11/2018 Gamarnik
2018/0330824 A1 11/2018 Athey et al.
2018/0353812 A1 12/2018 Lannon et al.
2018/0360340 A1 12/2018 Rehse et al.
2018/0366225 A1 12/2018 Mansi et al.
2018/0373844 A1 12/2018 Ferrandez-Escamez et al.
2019/0005195 A1 1/2019 Peterson
2019/0009135 A1 1/2019 Wu
2019/0019163 A1 1/2019 Batey et al.
2019/0019573 A1 1/2019 Lake et al.
2019/0019578 A1 1/2019 Vaccaro
2019/0030415 A1 1/2019 Volpe, Jr.
2019/0031284 A1 1/2019 Fuchs
2019/0046794 A1 2/2019 Goodall et al.
2019/0060708 A1 2/2019 Fung
2019/0065970 A1 2/2019 Bonutti et al.
2019/0066832 A1* 2/2019 Kang ..... A61B 5/1128
2019/0076701 A1 3/2019 Dugan
2019/0080802 A1 3/2019 Ziobro et al.
2019/0083846 A1 3/2019 Eder
2019/0088356 A1 3/2019 Oliver et al.
2019/0090744 A1 3/2019 Mahfouz
2019/0096534 A1 3/2019 Joao
2019/0105551 A1 4/2019 Ray
2019/0108912 A1 4/2019 Spurlock, III
2019/0111299 A1* 4/2019 Radcliffe ..... A61H 1/0274
2019/0115097 A1 4/2019 Macoviak et al.
2019/0117156 A1 4/2019 Howard et al.
2019/0118038 A1 4/2019 Tana et al.
2019/0118066 A1 4/2019 Cardona
2019/0126099 A1 5/2019 Hoang
2019/0132948 A1 5/2019 Longinotti-Buitoni et al.
2019/0134454 A1 5/2019 Mahoney et al.
2019/0137988 A1 5/2019 Cella et al.
2019/0143191 A1 5/2019 Ran et al.
2019/0143193 A1 5/2019 Kim
2019/0145774 A1 5/2019 Ellis
2019/0163876 A1 5/2019 Remme et al.
2019/0167988 A1 6/2019 Shahriari et al.
2019/0172587 A1 6/2019 Park et al.
2019/0175988 A1 6/2019 Volterrani et al.
2019/0183715 A1 6/2019 Kapure et al.
2019/0200920 A1 7/2019 Tien et al.
2019/0209891 A1 7/2019 Fung
2019/0214119 A1 7/2019 Wachira et al.
2019/0223797 A1 7/2019 Tran
2019/0224528 A1 7/2019 Omid-Zohoor et al.
2019/0228856 A1 7/2019 Leifer
2019/0232108 A1 8/2019 Kovach et al.
2019/0240103 A1 8/2019 Hepler et al.
2019/0240541 A1 8/2019 Denton et al.
2019/0244540 A1 8/2019 Errante et al.
2019/0247718 A1 8/2019 Blevins
2019/0251456 A1 8/2019 Constantin
2019/0261959 A1 8/2019 Frankel
2019/0262084 A1 8/2019 Roh
2019/0269343 A1 9/2019 Ramos Murguialday et al.
2019/0274523 A1 9/2019 Bates et al.
2019/0275368 A1 9/2019 Maroldi
2019/0283247 A1 9/2019 Chang
2019/0304584 A1 10/2019 Savolainen
2019/0307983 A1 10/2019 Goldman
2019/0314681 A1 10/2019 Yang
2019/0344123 A1 11/2019 Rubin et al.
2019/0354632 A1 11/2019 Mital et al.
2019/0362242 A1 11/2019 Pillai et al.
2019/0366146 A1 12/2019 Tong et al.
2019/0371472 A1 12/2019 Blanchard
2019/0385199 A1 12/2019 Bender et al.
2019/0388728 A1 12/2019 Wang et al.
2019/0392936 A1 12/2019 Arric et al.
2019/0392939 A1 12/2019 Basta et al.
2020/0005928 A1 1/2020 Daniel
2020/0034665 A1 1/2020 Ghanta
2020/0034707 A1 1/2020 Kivatinos et al.
2020/0038703 A1 2/2020 Cleary et al.
2020/0051446 A1 2/2020 Rubinstein
2020/0054922 A1 2/2020 Azaria
2020/0066390 A1* 2/2020 Svendrys ..... G06F 3/0346
2020/0085300 A1 3/2020 Kwatra et al.
2020/0090802 A1 3/2020 Maron
2020/0093418 A1 3/2020 Kluger et al.
2020/0121987 A1 4/2020 Loh
2020/0129808 A1 4/2020 Fomin
2020/0139194 A1 5/2020 Min
2020/0143922 A1 5/2020 Chekroud et al.
2020/0151595 A1 5/2020 Jayalath et al.
2020/0151646 A1 5/2020 De La Fuente Sanchez
2020/0152339 A1 5/2020 Pulitzer et al.
2020/0160198 A1 5/2020 Reeves et al.
2020/0170876 A1 6/2020 Kapure et al.
2020/0176098 A1 6/2020 Lucas et al.
2020/0188774 A1 6/2020 Fung

(56) References Cited

U.S. PATENT DOCUMENTS

2020/0197744 A1 6/2020 Schweighofer
2020/0221975 A1 7/2020 Basta et al.
2020/0237291 A1 7/2020 Raja
2020/0237452 A1 7/2020 Wolf et al.
2020/0261763 A1 8/2020 Park
2020/0267487 A1 8/2020 Siva
2020/0275886 A1 9/2020 Mason
2020/0289045 A1 9/2020 Hacking et al.
2020/0289046 A1 9/2020 Hacking et al.
2020/0289879 A1 9/2020 Hacking et al.
2020/0289880 A1 9/2020 Hacking et al.
2020/0289881 A1 9/2020 Hacking et al.
2020/0289889 A1 9/2020 Hacking et al.
2020/0293712 A1 9/2020 Potts et al.
2020/0303063 A1 9/2020 Sharma et al.
2020/0312447 A1 10/2020 Bohn et al.
2020/0320454 A1 10/2020 Almashor
2020/0334972 A1 10/2020 Gopalakrishnan
2020/0353314 A1 11/2020 Messinger
2020/0357299 A1 11/2020 Patel et al.
2020/0365256 A1 11/2020 Hayashitani et al.
2020/0391080 A1 12/2020 Powers
2020/0395112 A1 12/2020 Ronner
2020/0398083 A1 12/2020 Adelsheim
2020/0401224 A1 12/2020 Cotton
2020/0402662 A1 12/2020 Esmailian et al.
2020/0410374 A1 12/2020 White
2020/0410385 A1 12/2020 Otsuki
2020/0411162 A1 12/2020 Lien et al.
2020/0411170 A1 12/2020 Brown
2021/0005224 A1 1/2021 Rothschild et al.
2021/0005319 A1 1/2021 Otsuki et al.
2021/0008413 A1 1/2021 Asikainen et al.
2021/0015560 A1 1/2021 Boddington et al.
2021/0027889 A1 1/2021 Neil et al.
2021/0035674 A1 2/2021 Volosin et al.
2021/0050086 A1 2/2021 Rose et al.
2021/0065855 A1 3/2021 Pepin et al.
2021/0074178 A1 3/2021 Tlan et al.
2021/0076981 A1 3/2021 Hacking et al.
2021/0077860 A1 3/2021 Posnack et al.
2021/0077884 A1 3/2021 De Las Casas Zolezzi et al.
2021/0082554 A1 3/2021 Kalia et al.
2021/0093891 A1 4/2021 Sheng
2021/0098099 A1 4/2021 Neumann
2021/0098129 A1 4/2021 Neumann
2021/0101051 A1 4/2021 Posnack et al.
2021/0113890 A1 4/2021 Posnack et al.
2021/0125696 A1 4/2021 Liu et al.
2021/0127974 A1 5/2021 Mason et al.
2021/0128080 A1 5/2021 Mason et al.
2021/0128255 A1 5/2021 Mason et al.
2021/0128978 A1 5/2021 Gilstrom et al.
2021/0134412 A1 5/2021 Guaneri et al.
2021/0134425 A1 5/2021 Mason et al.
2021/0134428 A1 5/2021 Mason
2021/0134430 A1 5/2021 Mason et al.
2021/0134432 A1 5/2021 Mason et al.
2021/0134456 A1 5/2021 Posnack et al.
2021/0134457 A1 5/2021 Mason et al.
2021/0134458 A1 5/2021 Mason et al.
2021/0134463 A1 5/2021 Mason et al.
2021/0138304 A1 5/2021 Mason et al.
2021/0142875 A1 5/2021 Mason et al.
2021/0142893 A1 5/2021 Guaneri et al.
2021/0142898 A1 5/2021 Mason et al.
2021/0142903 A1 5/2021 Mason et al.
2021/0144074 A1 5/2021 Guaneri et al.
2021/0186419 A1 6/2021 Van Ee et al.
2021/0187348 A1 6/2021 Phillips et al.
2021/0202090 A1 7/2021 ODonovan et al.
2021/0202103 A1 7/2021 Bostic et al.
2021/0205660 A1 7/2021 Shavit
2021/0236020 A1 8/2021 Matijevich et al.
2021/0240853 A1 8/2021 Carlson
2021/0244998 A1 8/2021 Hacking et al.
2021/0245003 A1 8/2021 Turner
2021/0251562 A1 8/2021 Jain
2021/0272677 A1 9/2021 Barbee
2021/0338469 A1 11/2021 Dempers
2021/0343384 A1 11/2021 Purushothaman et al.
2021/0345879 A1 11/2021 Mason et al.
2021/0345975 A1 11/2021 Mason et al.
2021/0350888 A1 11/2021 Guaneri et al.
2021/0350898 A1 11/2021 Mason et al.
2021/0350899 A1 11/2021 Mason et al.
2021/0350901 A1 11/2021 Mason et al.
2021/0350902 A1 11/2021 Mason et al.
2021/0350914 A1 11/2021 Guaneri et al.
2021/0350926 A1 11/2021 Mason et al.
2021/0354002 A1 11/2021 Schaefer
2021/0361514 A1 11/2021 Choi et al.
2021/0366587 A1 11/2021 Mason et al.
2021/0375425 A1 12/2021 Zhang
2021/0383909 A1 12/2021 Mason et al.
2021/0391091 A1 12/2021 Mason
2021/0398668 A1 12/2021 Chock et al.
2021/0407670 A1 12/2021 Mason et al.
2021/0407681 A1 12/2021 Mason et al.
2022/0000556 A1 1/2022 Casey et al.
2022/0015838 A1 1/2022 Posnack
2022/0016480 A1 1/2022 Bissonnette et al.
2022/0016482 A1 1/2022 Bissonnette
2022/0016485 A1 1/2022 Bissonnette
2022/0016486 A1 1/2022 Bissonnette
2022/0020469 A1 1/2022 Tanner
2022/0044806 A1 2/2022 Sanders et al.
2022/0047921 A1 2/2022 Bissonnette
2022/0066548 A1 3/2022 Helot
2022/0079690 A1 3/2022 Mason et al.
2022/0080256 A1 3/2022 Arn et al.
2022/0080265 A1 3/2022 Watterson
2022/0105384 A1 4/2022 Hacking et al.
2022/0105385 A1 4/2022 Hacking et al.
2022/0105390 A1 4/2022 Yuasa
2022/0115133 A1 4/2022 Mason et al.
2022/0118218 A1 4/2022 Bense et al.
2022/0122724 A1 4/2022 Durlach et al.
2022/0126169 A1 4/2022 Mason
2022/0133576 A1 5/2022 Choi et al.
2022/0148725 A1 5/2022 Mason et al.
2022/0158916 A1 5/2022 Mason et al.
2022/0176039 A1 6/2022 Lintereur et al.
2022/0181004 A1 6/2022 Zilca et al.
2022/0193491 A1 6/2022 Mason
2022/0230729 A1 7/2022 Mason
2022/0238222 A1 7/2022 Neuberg
2022/0238223 A1 7/2022 Mason
2022/0258935 A1 8/2022 Kraft
2022/0262483 A1 8/2022 Rosenberg et al.
2022/0262504 A1 8/2022 Bratty et al.
2022/0266094 A1 8/2022 Mason et al.
2022/0270738 A1 8/2022 Mason et al.
2022/0273985 A1 9/2022 Jeong et al.
2022/0273986 A1 9/2022 Mason
2022/0288460 A1 9/2022 Mason
2022/0288461 A1 9/2022 Ashley et al.
2022/0288462 A1 9/2022 Ashley et al.
2022/0293257 A1 9/2022 Guaneri et al.
2022/0300787 A1 9/2022 Wall et al.
2022/0304881 A1 9/2022 Choi et al.
2022/0304882 A1 9/2022 Choi
2022/0305328 A1 9/2022 Choi et al.
2022/0314072 A1 10/2022 Bissonnette et al.
2022/0314075 A1 10/2022 Mason et al.
2022/0323826 A1 10/2022 Khurana
2022/0327714 A1 10/2022 Cook et al.
2022/0327807 A1 10/2022 Cook et al.
2022/0328181 A1 10/2022 Mason et al.
2022/0330823 A1 10/2022 Janssen
2022/0331663 A1 10/2022 Mason
2022/0338761 A1 10/2022 Maddahi et al.
2022/0339052 A1 10/2022 Kim
2022/0339501 A1 10/2022 Mason et al.

(56) References Cited

U.S. PATENT DOCUMENTS

| | | | |
|---|---|---|---|
| 2022/0370851 | A1 | 11/2022 | Guidarelli et al. |
| 2022/0384010 | A1 | 12/2022 | Kanayama |
| 2022/0384012 | A1 | 12/2022 | Mason |
| 2022/0392591 | A1 | 12/2022 | Guaneri et al. |
| 2022/0395232 | A1 | 12/2022 | Locke |
| 2022/0401783 | A1 | 12/2022 | Choi |
| 2022/0415469 | A1 | 12/2022 | Mason |
| 2022/0415471 | A1 | 12/2022 | Mason |
| 2023/0001268 | A1 | 1/2023 | Bissonnette et al. |
| 2023/0013530 | A1 | 1/2023 | Mason |
| 2023/0014598 | A1 | 1/2023 | Mason et al. |
| 2023/0029639 | A1 | 2/2023 | Roy |
| 2023/0047253 | A1 | 2/2023 | Gnanasambandam et al. |
| 2023/0048040 | A1 | 2/2023 | Hacking et al. |
| 2023/0051751 | A1 | 2/2023 | Hacking et al. |
| 2023/0058605 | A1 | 2/2023 | Mason |
| 2023/0060039 | A1 | 2/2023 | Mason |
| 2023/0072368 | A1 | 3/2023 | Mason |
| 2023/0078793 | A1 | 3/2023 | Mason |
| 2023/0119461 | A1 | 4/2023 | Mason |
| 2023/0190100 | A1 | 6/2023 | Stump |
| 2023/0197240 | A1 | 6/2023 | Rosenberg |
| 2023/0201656 | A1 | 6/2023 | Hacking et al. |
| 2023/0207097 | A1 | 6/2023 | Mason |
| 2023/0207124 | A1 | 6/2023 | Walsh et al. |
| 2023/0215539 | A1 | 7/2023 | Rosenberg et al. |
| 2023/0215552 | A1 | 7/2023 | Khotilovich et al. |
| 2023/0218950 | A1 | 7/2023 | Belson et al. |
| 2023/0245747 | A1 | 8/2023 | Rosenberg et al. |
| 2023/0245748 | A1 | 8/2023 | Rosenberg et al. |
| 2023/0245750 | A1 | 8/2023 | Rosenberg et al. |
| 2023/0245751 | A1 | 8/2023 | Rosenberg et al. |
| 2023/0249599 | A1 | 8/2023 | Nicola |
| 2023/0253089 | A1 | 8/2023 | Rosenberg et al. |
| 2023/0255555 | A1 | 8/2023 | Sundaram et al. |
| 2023/0263428 | A1 | 8/2023 | Hull et al. |
| 2023/0274813 | A1 | 8/2023 | Rosenberg et al. |
| 2023/0282329 | A1 | 9/2023 | Mason et al. |
| 2023/0364472 | A1 | 11/2023 | Posnack |
| 2023/0368886 | A1 | 11/2023 | Rosenberg |
| 2023/0377710 | A1 | 11/2023 | Chen et al. |
| 2023/0377711 | A1 | 11/2023 | Rosenberg |
| 2023/0377712 | A1 | 11/2023 | Rosenberg |
| 2023/0386639 | A1 | 11/2023 | Rosenberg |
| 2023/0395231 | A1 | 12/2023 | Rosenberg |
| 2023/0395232 | A1 | 12/2023 | Rosenberg |
| 2024/0029856 | A1 | 1/2024 | Rosenberg |
| 2024/0058651 | A1 | 2/2024 | Bissonnette |
| 2024/0177846 | A1 | 5/2024 | Gnanasambandam |
| 2024/0203580 | A1 | 6/2024 | Mason |

FOREIGN PATENT DOCUMENTS

| | | | | | |
|---|---|---|---|---|---|
| CN | 101964151 | A | | 2/2011 | |
| CN | 201889024 | U | | 7/2011 | |
| CN | 202220794 | U | | 5/2012 | |
| CN | 102670381 | A | | 9/2012 | |
| CN | 103263336 | A | | 8/2013 | |
| CN | 103390357 | A | | 11/2013 | |
| CN | 103473631 | A | | 12/2013 | |
| CN | 103488880 | A | | 1/2014 | |
| CN | 103501328 | A | | 1/2014 | |
| CN | 103721343 | A | | 4/2014 | |
| CN | 203677851 | U | | 7/2014 | |
| CN | 104335211 | A | | 2/2015 | |
| CN | 105263448 | A | * | 1/2016 | ..... A61B 5/112 |
| CN | 105620643 | A | | 6/2016 | |
| CN | 105683977 | A | | 6/2016 | |
| CN | 103136447 | B | | 8/2016 | |
| CN | 105894088 | A | | 8/2016 | |
| CN | 105930668 | A | | 9/2016 | |
| CN | 205626871 | U | | 10/2016 | |
| CN | 106127646 | A | | 11/2016 | |
| CN | 106236502 | A | | 12/2016 | |
| CN | 106510985 | A | | 3/2017 | |
| CN | 106621195 | A | | 5/2017 | |
| CN | 107025373 | A | | 8/2017 | |
| CN | 107066819 | A | | 8/2017 | |
| CN | 107430641 | A | | 12/2017 | |
| CN | 107551475 | A | | 1/2018 | |
| CN | 107736982 | A | | 2/2018 | |
| CN | 107930021 | A | | 4/2018 | |
| CN | 108078737 | A | | 5/2018 | |
| CN | 207429102 | U | | 6/2018 | |
| CN | 208224811 | A | | 12/2018 | |
| CN | 109191954 | A | | 1/2019 | |
| CN | 109248432 | A | | 1/2019 | |
| CN | 109308940 | A | | 2/2019 | |
| CN | 109363887 | A | | 2/2019 | |
| CN | 109431742 | A | | 3/2019 | |
| CN | 208573971 | U | | 3/2019 | |
| CN | 110148472 | A | | 8/2019 | |
| CN | 110201358 | A | | 9/2019 | |
| CN | 110215188 | A | | 9/2019 | |
| CN | 110322957 | A | | 10/2019 | |
| CN | 110613585 | A | | 12/2019 | |
| CN | 110721438 | A | | 1/2020 | |
| CN | 110808092 | A | | 2/2020 | |
| CN | 110931103 | A | | 3/2020 | |
| CN | 110993057 | A | | 4/2020 | |
| CN | 210384372 | U | | 4/2020 | |
| CN | 111084618 | A | | 5/2020 | |
| CN | 111105859 | A | | 5/2020 | |
| CN | 111111110 | A | | 5/2020 | |
| CN | 111199787 | A | | 5/2020 | |
| CN | 210447971 | U | | 5/2020 | |
| CN | 111329674 | A | | 6/2020 | |
| CN | 111370088 | A | | 7/2020 | |
| CN | 111460305 | A | | 7/2020 | |
| CN | 111544834 | A | | 8/2020 | |
| CN | 111714832 | A | | 9/2020 | |
| CN | 111790111 | A | | 10/2020 | |
| CN | 211635070 | U | | 10/2020 | |
| CN | 211798556 | U | | 10/2020 | |
| CN | 111973956 | A | | 11/2020 | |
| CN | 112071393 | A | | 12/2020 | |
| CN | 212067582 | U | | 12/2020 | |
| CN | 212141371 | U | | 12/2020 | |
| CN | 112190440 | A | | 1/2021 | |
| CN | 112289425 | A | | 1/2021 | |
| CN | 212522890 | U | | 2/2021 | |
| CN | 212624809 | U | | 2/2021 | |
| CN | 212730865 | U | | 3/2021 | |
| CN | 112603295 | A | | 4/2021 | |
| CN | 213049207 | U | | 4/2021 | |
| CN | 213077324 | U | | 4/2021 | |
| CN | 213190965 | U | | 5/2021 | |
| CN | 213220742 | U | | 5/2021 | |
| CN | 213823322 | U | | 7/2021 | |
| CN | 213851851 | U | | 8/2021 | |
| CN | 213994716 | U | | 8/2021 | |
| CN | 113384850 | A | | 9/2021 | |
| CN | 113421642 | A | | 9/2021 | |
| CN | 214232565 | U | | 9/2021 | |
| CN | 113499572 | A | | 10/2021 | |
| CN | 113521655 | A | | 10/2021 | |
| CN | 214388673 | U | | 10/2021 | |
| CN | 214763119 | U | | 11/2021 | |
| CN | 214806540 | U | | 11/2021 | |
| CN | 214913108 | U | | 11/2021 | |
| CN | 215025723 | U | | 12/2021 | |
| CN | 215084603 | U | | 12/2021 | |
| CN | 215136488 | U | | 12/2021 | |
| CN | 113885361 | A | | 1/2022 | |
| CN | 114049961 | A | | 2/2022 | |
| CN | 114203274 | A | | 3/2022 | |
| CN | 216258145 | U | | 4/2022 | |
| CN | 216366476 | U | | 4/2022 | |
| CN | 216497237 | U | | 5/2022 | |
| CN | 114632302 | A | | 6/2022 | |
| CN | 114694824 | A | | 7/2022 | |
| CN | 114898832 | A | | 8/2022 | |
| CN | 217246501 | U | | 8/2022 | |
| CN | 114983760 | A | | 9/2022 | |

(56) References Cited

FOREIGN PATENT DOCUMENTS

| | | | |
|---|---|---|---|
| CN | 114983761 | A | 9/2022 |
| CN | 115006789 | A | 9/2022 |
| CN | 115089917 | A | 9/2022 |
| CN | 217472652 | U | 9/2022 |
| CN | 110270062 | B | 10/2022 |
| CN | 217612764 | U | 10/2022 |
| CN | 115337599 | A | 11/2022 |
| CN | 115382062 | A | 11/2022 |
| CN | 115487042 | A | 12/2022 |
| CN | 218187703 | U | 1/2023 |
| CN | 218187717 | U | 1/2023 |
| CN | 218420859 | U | 2/2023 |
| CN | 115954081 | A | 4/2023 |
| DE | 95019 | C | 1/1897 |
| DE | 7628633 | U1 | 12/1977 |
| DE | 8519150 | U1 | 10/1985 |
| DE | 3732905 | A1 | 7/1988 |
| DE | 19619820 | A1 | 12/1996 |
| DE | 29620008 | U1 | 2/1997 |
| DE | 19947926 | A1 | 4/2001 |
| DE | 102007025664 | A1 | 12/2008 |
| DE | 102018202497 | A1 | 8/2018 |
| DE | 102018211212 | A1 | 1/2019 |
| DE | 102019108425 | B3 | 8/2020 |
| EP | 199600 | A2 | 10/1986 |
| EP | 0383137 | A2 | 8/1990 |
| EP | 634319 | A2 | 1/1995 |
| EP | 0919259 | A1 | 6/1999 |
| EP | 1034817 | A1 | 9/2000 |
| EP | 1159989 | A1 | 12/2001 |
| EP | 1391179 | A1 | 2/2004 |
| EP | 1968028 | | 9/2008 |
| EP | 2564904 | A1 | 3/2013 |
| EP | 2575064 | A1 | 4/2013 |
| EP | 1909730 | B1 | 4/2014 |
| EP | 2815242 | A4 | 12/2014 |
| EP | 2869805 | A | 5/2015 |
| EP | 2997951 | A1 | 3/2016 |
| EP | 2688472 | B1 | 4/2016 |
| EP | 3264303 | A1 | 1/2018 |
| EP | 3323473 | A1 | 5/2018 |
| EP | 3547322 | A1 | 10/2019 |
| EP | 3627514 | A1 | 3/2020 |
| EP | 3671700 | A1 | 6/2020 |
| EP | 3688537 | A1 | 8/2020 |
| EP | 3731733 | A1 | 11/2020 |
| EP | 3984508 | A1 | 4/2022 |
| EP | 3984509 | A1 | 4/2022 |
| EP | 3984510 | A1 | 4/2022 |
| EP | 3984511 | A1 | 4/2022 |
| EP | 3984512 | A1 | 4/2022 |
| EP | 3984513 | A1 | 4/2022 |
| EP | 4054699 | A1 | 9/2022 |
| EP | 4112033 | A1 | 1/2023 |
| FR | 2527541 | A2 | 12/1983 |
| FR | 3127393 | A1 | 3/2023 |
| GB | 141664 | A | 11/1920 |
| GB | 2336140 | A | 10/1999 |
| GB | 2372459 | A | 8/2002 |
| GB | 2512431 | A | 10/2014 |
| GB | 2591542 | B | 3/2022 |
| IN | 23/2009 | | 5/2009 |
| IN | 201811043670 | A | 7/2018 |
| JP | 2000005339 | A | 1/2000 |
| JP | 2003225875 | A | 8/2003 |
| JP | 2005227928 | A | 8/2005 |
| JP | 2005227928 | A1 | 8/2005 |
| JP | 2009112336 | A | 5/2009 |
| JP | 2013515995 | A | 5/2013 |
| JP | 2014104139 | A | 6/2014 |
| JP | 3193662 | U | 10/2014 |
| JP | 3198173 | U | 6/2015 |
| JP | 5804063 | B2 | 11/2015 |
| JP | 2018102842 | A | 7/2018 |
| JP | 6454071 | B2 | 1/2019 |
| JP | 2019028647 | A | 2/2019 |
| JP | 2019134909 | A | 8/2019 |
| JP | 6573739 | B1 | 9/2019 |
| JP | 6659831 | B2 | 3/2020 |
| JP | 2020057082 | A | 4/2020 |
| JP | 6710357 | B1 | 6/2020 |
| JP | 6775757 | B1 | 10/2020 |
| JP | 2021027917 | A | 2/2021 |
| JP | 2021040882 | A | 3/2021 |
| JP | 6871379 | B2 | 5/2021 |
| JP | 2022521378 | A | 4/2022 |
| JP | 3238491 | U | 7/2022 |
| JP | 7198364 | B2 | 12/2022 |
| JP | 7202474 | B2 | 1/2023 |
| JP | 7231750 | B2 | 3/2023 |
| JP | 7231751 | B2 | 3/2023 |
| JP | 7231752 | B2 | 3/2023 |
| KR | 20020009724 | A | 2/2002 |
| KR | 200276919 | Y1 | 5/2002 |
| KR | 20020065253 | A | 8/2002 |
| KR | 20040082259 | A | 9/2004 |
| KR | 100582596 | B1 | 5/2006 |
| KR | 101042258 | B1 | 6/2011 |
| KR | 101258250 | B1 | 4/2013 |
| KR | 101325581 | B1 | 11/2013 |
| KR | 20140128630 | A | 11/2014 |
| KR | 20150017693 | A | 2/2015 |
| KR | 20150078191 | A | 7/2015 |
| KR | 101580071 | B1 | 12/2015 |
| KR | 101647620 | B1 | 8/2016 |
| KR | 20160093990 | A | 8/2016 |
| KR | 20170038837 | A | 4/2017 |
| KR | 20170086922 | A | 7/2017 |
| KR | 20180004928 | A | 1/2018 |
| KR | 20190016727 | A | 2/2019 |
| KR | 20190029175 | A | 3/2019 |
| KR | 20190056116 | A | 5/2019 |
| KR | 101988167 | B1 | 6/2019 |
| KR | 101969392 | B1 | 8/2019 |
| KR | 102038055 | B1 | 10/2019 |
| KR | 102043239 | B1 | 11/2019 |
| KR | 102055279 | B1 | 12/2019 |
| KR | 20200019548 | A | 2/2020 |
| KR | 102088333 | B1 | 3/2020 |
| KR | 20200025290 | A | 3/2020 |
| KR | 20200029180 | A | 3/2020 |
| KR | 102097190 | B1 | 4/2020 |
| KR | 102116664 | B1 | 5/2020 |
| KR | 102116968 | B1 | 5/2020 |
| KR | 20200056233 | A | 5/2020 |
| KR | 102120828 | B1 | 6/2020 |
| KR | 102121586 | B1 | 6/2020 |
| KR | 102142713 | B1 | 8/2020 |
| KR | 102162522 | B1 | 10/2020 |
| KR | 20200119665 | A | 10/2020 |
| KR | 102173553 | B1 | 11/2020 |
| KR | 102180079 | B1 | 11/2020 |
| KR | 102188766 | B1 | 12/2020 |
| KR | 102196793 | B1 | 12/2020 |
| KR | 20210006212 | A | 1/2021 |
| KR | 102224188 | B1 | 3/2021 |
| KR | 102224618 | B1 | 3/2021 |
| KR | 102246049 | B1 | 4/2021 |
| KR | 102246050 | B1 | 4/2021 |
| KR | 102246051 | B1 | 4/2021 |
| KR | 102246052 | B1 | 4/2021 |
| KR | 20210052028 | A | 5/2021 |
| KR | 102264498 | B1 | 6/2021 |
| KR | 102352602 | B1 | 1/2022 |
| KR | 102352603 | B1 | 1/2022 |
| KR | 102352604 | B1 | 1/2022 |
| KR | 20220004639 | A | 1/2022 |
| KR | 102387577 | B1 | 4/2022 |
| KR | 102421437 | B1 | 7/2022 |
| KR | 20220102207 | A | 7/2022 |
| KR | 102427545 | B1 | 8/2022 |
| KR | 102467495 | B1 | 11/2022 |
| KR | 102467496 | B1 | 11/2022 |
| KR | 102469723 | B1 | 11/2022 |

(56) References Cited

FOREIGN PATENT DOCUMENTS

| | | | | |
|---|---|---|---|---|
| KR | 102471990 | B1 | 11/2022 | |
| KR | 20220145989 | A | 11/2022 | |
| KR | 20220156134 | A | 11/2022 | |
| KR | 102502744 | B1 | 2/2023 | |
| KR | 20230019349 | A | 2/2023 | |
| KR | 20230019350 | A | 2/2023 | |
| KR | 20230026556 | A | 2/2023 | |
| KR | 20230026668 | A | 2/2023 | |
| KR | 20230040526 | | 3/2023 | |
| KR | 20230050506 | A | 4/2023 | |
| KR | 20230056118 | A | 4/2023 | |
| KR | 102528503 | B1 | 5/2023 | |
| KR | 102531930 | B1 | 5/2023 | |
| KR | 102532766 | B1 | 5/2023 | |
| KR | 102539190 | B1 | 6/2023 | |
| PL | P.401020 | | 4/2014 | |
| RU | 2154460 | C2 | 8/2000 | |
| RU | 2014131288 | A | 2/2016 | |
| RU | 2607953 | C2 | 1/2017 | |
| RU | 2738571 | C1 | 12/2020 | |
| TW | M474545 | U | 3/2014 | |
| TW | I442956 | B | 7/2014 | |
| TW | M638437 | U | 3/2023 | |
| WO | 1998009687 | A1 | 3/1998 | |
| WO | 9912468 | | 3/1999 | |
| WO | 0149235 | A2 | 7/2001 | |
| WO | 0151083 | A2 | 7/2001 | |
| WO | 2001050387 | A1 | 7/2001 | |
| WO | 2001056465 | A1 | 8/2001 | |
| WO | 02062211 | A2 | 8/2002 | |
| WO | 02093312 | A2 | 11/2002 | |
| WO | 2003043494 | A1 | 5/2003 | |
| WO | 2005018453 | A1 | 3/2005 | |
| WO | WO-2005074369 | A2 * | 8/2005 | ..... A61B 5/103 |
| WO | 2006004430 | A2 | 1/2006 | |
| WO | 2006012694 | A1 | 2/2006 | |
| WO | 2007102709 | A1 | 9/2007 | |
| WO | 2008114291 | A1 | 9/2008 | |
| WO | 2009003170 | A1 | 12/2008 | |
| WO | 2009008968 | A1 | 1/2009 | |
| WO | 2011025322 | A2 | 3/2011 | |
| WO | 2012128801 | A1 | 9/2012 | |
| WO | 2013002568 | A2 | 1/2013 | |
| WO | 2023164292 | A1 | 3/2013 | |
| WO | 2013122839 | A1 | 8/2013 | |
| WO | 2014011447 | A1 | 1/2014 | |
| WO | 2014039567 | A1 | 3/2014 | |
| WO | 2014163976 | A1 | 10/2014 | |
| WO | 2015026744 | A1 | 2/2015 | |
| WO | 2015065298 | A1 | 5/2015 | |
| WO | 2015082555 | A1 | 6/2015 | |
| WO | 2016151364 | A1 | 9/2016 | |
| WO | 2016154318 | A1 | 9/2016 | |
| WO | 2017030781 | A1 | 2/2017 | |
| WO | 2017166074 | A1 | 5/2017 | |
| WO | 2017091691 | A1 | 6/2017 | |
| WO | 2017165238 | A1 | 9/2017 | |
| WO | 2018081795 | A1 | 5/2018 | |
| WO | 2018171853 | A1 | 9/2018 | |
| WO | 2019022706 | A1 | 1/2019 | |
| WO | 2019143940 | A1 | 7/2019 | |
| WO | 2020075190 | A1 | 4/2020 | |
| WO | 2020130979 | A1 | 6/2020 | |
| WO | 2020149815 | A2 | 7/2020 | |
| WO | 2020158904 | A1 | 8/2020 | |
| WO | 2020229705 | A1 | 11/2020 | |
| WO | 2020245727 | A1 | 12/2020 | |
| WO | 2020249855 | A1 | 12/2020 | |
| WO | 2020252599 | A1 | 12/2020 | |
| WO | 2020256577 | A1 | 12/2020 | |
| WO | 2021021447 | A1 | 2/2021 | |
| WO | 2021022003 | A1 | 2/2021 | |
| WO | 2021038980 | A1 | 3/2021 | |
| WO | 2021055427 | A1 | 3/2021 | |
| WO | 2021061061 | A1 | 4/2021 | |
| WO | 2021090267 | A1 | 5/2021 | |
| WO | 2021138620 | A1 | 7/2021 | |
| WO | 2021216881 | A1 | 10/2021 | |
| WO | 2021236961 | A1 | 11/2021 | |
| WO | 2022047006 | A1 | 3/2022 | |
| WO | 2022092493 | A1 | 5/2022 | |
| WO | 2022092494 | A1 | 5/2022 | |
| WO | 2022212883 | A1 | 10/2022 | |
| WO | 2022212921 | A1 | 10/2022 | |
| WO | 2022216498 | A1 | 10/2022 | |
| WO | 2022251420 | A1 | 12/2022 | |
| WO | 2023008680 | A1 | 2/2023 | |
| WO | 2023008681 | A1 | 2/2023 | |
| WO | 2023022319 | A1 | 2/2023 | |
| WO | 2023022320 | A1 | 2/2023 | |
| WO | 2023052695 | A1 | 4/2023 | |
| WO | 2023091496 | A1 | 5/2023 | |
| WO | 2023215155 | A1 | 11/2023 | |
| WO | 2023230075 | A1 | 11/2023 | |
| WO | 2024013267 | A1 | 1/2024 | |
| WO | 2024107807 | A1 | 5/2024 | |

OTHER PUBLICATIONS

International Searching Authority, International Preliminary Report on Patentability of International Application No. PCT/US2017/50895, Date of Mailing Dec. 11, 2018, 52 pages.

International Searching Authority, Search Report and Written Opinion for International Application No. PCT/US2017/50895, Date of Mailing Jan. 12, 2018, 6 pages.

International Searching Authority, Search Report and Written Opinion for International Application No. PCT/US2020/021876, Date of Mailing May 28, 2020, 8 pages.

International Searching Authority, Search Report and Written Opinion for International Application No. PCT/US2020/051008, Date of Mailing Dec. 10, 2020, 9 pages.

International Searching Authority, Search Report and Written Opinion for International Application No. PCT/US2020/056661, Date of Mailing Feb. 12, 2021, 12 pages.

International Searching Authority, Search Report and Written Opinion for International Application No. PCT/US2021/032807, Date of Mailing Sep. 6, 2021, 11 pages.

Matrix, R3xm Recumbent Cycle, retrieved on Aug. 4, 2020, 7 pages, https://www.matrixfitness.com/en/cardio/cycles/r3xm-recumbent.

ROM3 Rehab, ROM3 Rehab System, Apr. 20, 2015, retrieved on Aug. 31, 2018, 12 pages, https://vimeo.com/125438463.

Ahmed et al., "Artificial Intelligence With Multi-Functional Machine Learning Platform Development for Better Healthcare and Precision Medicine," Database (Oxford), 2020, pp. 1-35, vol. 2020.

Davenport et al., "The Potential For Artificial Intelligence in Healthcare," Future Healthcare Journal, 2019, pp. 94-98, vol. 6, No. 2.

Alcaraz et al., "Machine Learning as Digital Therapy Assessment for Mobile Gait Rehabilitation," 2018 IEEE 28th International Workshop on Machine Learning for Signal Processing (MLSP), Aalborg, Denmark, 2018, 6 pages.

Androutsou et al., "A Smartphone Application Designed to Engage the Elderly in Home-Based Rehabilitation," Frontiers in Digital Health, Sep. 2020, vol. 2, Article 15, 13 pages.

Silva et al., "SapoFitness: A mobile health application for dietary evaluation," 2011 IEEE 13th International Conference on U e-Health Networking, Applications and Services, Columbia, MO, USA, 2011, 6 pages.

Wang et al., "Interactive wearable systems for upper body rehabilitation: a systematic review," Journal of NeuroEngineering and Rehabilitation, 2017, 21 pages.

Marzolini et al., "Eligibility, Enrollment, and Completion of Exercise-Based Cardiac Rehabilitation Following Stroke Rehabilitation: What Are the Barriers?," Physical Therapy, vol. 100, No. 1, 2019, 13 pages.

Nijjar et al., "Randomized Trial of Mindfulness-Based Stress Reduction in Cardiac Patients Eligible for Cardiac Rehabilitation," Scientific Reports, 2019, 12 pages.

(56) References Cited

OTHER PUBLICATIONS

Lara et al., "Human-Robot Sensor Interface for Cardiac Rehabilitation," IEEE International Conference on Rehabilitation Robotics, Jul. 2017, 8 pages.
Ishraque et al., "Artificial Intelligence-Based Rehabilitation Therapy Exercise Recommendation System," 2018 IEEE Mit Undergraduate Research Technology Conference (URTC), Cambridge, MA, USA, 2018, 5 pages.
Zakari et al., "Are There Limitations to Exercise Benefits in Peripheral Arterial Disease?," Frontiers in Cardiovascular Medicine, Nov. 2018, vol. 5, Article 173, 12 pages.
You et al., "Including Blood Vasculature into a Game-Theoretic Model of Cancer Dynamics," Games 2019, 10, 13, 22 pages.
Jeong et al., "Computer-assisted upper extremity training using interactive biking exercise (iBikE) platform," Sep. 2012, 34th Annual International Conference of the IEEE EMBS, 5 pages.
Gerbild et al., "Physical Activity to Improve Erectile Dysfunction: A Systematic Review of Intervention Studies," Sexual Medicine, 2018, 15 pages.
Jeong et al., "Computer-assisted upper extremity training using interactive biking exercise (iBikE) platform," Sep. 2012, pp. 1-5, 34th Annual International Conference of the IEEE EMBS.
Website for "Pedal Exerciser", p. 1, retrieved on Sep. 9, 2022 from https://www.vivehealth.com/collections/physical-therapy-equipment/products/pedalexerciser.
Website for "Functional Knee Brace with ROM", p. 1, retrieved on Sep. 9, 2022 from http://medicalbrace.gr/en/product/functional-knee-brace-with-goniometer-mbtelescopicknee/.
Website for "ComfySplints Goniometer Knee", pp. 1-5, retrieved on Sep. 9, 2022 from https://www.comfysplints.com/product/knee-splints/.
Website for "BMI FlexEze Knee Corrective Orthosis (KCO)", pp. 1-4, retrieved on Sep. 9, 2022 from https://orthobmi.com/products/bmi-flexeze%C2%AE-knee-corrective-orthosis-kco.
Website for "Neoprene Knee Brace with goniometer—Patella ROM MB.4070", pp. 1-4, retrieved on Sep. 9, 2022 from https://www.fortuna.com.gr/en/product/neoprene-knee-brace-with-goniometer-patella-rom-mb-4070/.
Kuiken et al., "Computerized Biofeedback Knee Goniometer: Acceptance and Effect on Exercise Behavior in Post-total Knee Arthroplasty Rehabilitation," Biomedical Engineering Faculty Research and Publications, 2004, pp. 1-10.
Ahmed et al., "Artificial intelligence with multi-functional machine learning platform development for better healthcare and precision medicine," Database, 2020, pp. 1-35.
Davenport et al., "The potential for artificial intelligence in healthcare," Digital Technology, Future Healthcare Journal, 2019, pp. 1-5, vol. 6, No. 2.
Website for "OxeFit XS1", pp. 1-3, retrieved on Sep. 9, 2022 from https://www.oxefit.com/xs1.
Website for "Preva Mobile", pp. 1-6, retrieved on Sep. 9, 2022 from https://www.precor.com/en-us/resources/introducing-preva-mobile.
Website for "J-Bike", pp. 1-3, retrieved on Sep. 9, 2022 from https://www.magneticdays.com/en/cycling-for-physical-rehabilitation.
Website for "Excy", pp. 1-12, retrieved on Sep. 9, 2022 from https://excy.com/portable-exercise-rehabilitation-excy-xcs-pro/.
Website for "OxeFit XP1", p. 1, retrieved on Sep. 9, 2022 from https://www.oxefit.com/xp1.
Malloy, Online Article "Al-enabled EKGs find difference between numerical age and biological age significantly affects health, longevity", Website: https://newsnetwork.mayoclinic.org/discussion/ai-enabled-ekgs-find-difference-between-numerical-age-and-biological-age-significantly-affects-health-longevity/, Mayo Clinic News Network, May 20, 2021, retrieved: Jan. 23, 2023, p. 1-4.
Chrif et al., "Control design for a lower-limb paediatric therapy device using linear motor technology," Article, 2017, pp. 119-127, Science Direct, Switzerland.
Robben et al., "Delta Features From Ambient Sensor Data are Good Predictors of Change in Functional Health," Article, 2016, pp. 2168-2194, vol. 21, No. 4, IEEE Journal of Biomedical and Health Informatics.
Kantoch et al., "Recognition of Sedentary Behavior by Machine Learning Analysis of Wearable Sensors during Activities of Daily Living for Telemedical Assessment of Cardiovascular Risk," Article, 2018, 17 pages, Sensors, Poland.
Warburton et al., "International Launch of the Par-•Q+ and ePARmed-•X+ Validation of the PAR-•Q+ and ePARmed••X+," Health & Fitness Journal of Canada, 2011, 9 pages, vol. 4, No. 2.
Barrett et al., "Artificial intelligence supported patient self-care in chronic heart failure: a paradigm shift from reactive to predictive, preventive and personalised care," EPMA Journal (2019), pp. 445-464.
Oerkild et al., "Home-based cardiac rehabilitation is an attractive alternative to No. cardiac rehabilitation for elderly patients with coronary heart disease: results from a randomised clinical trial," BMJ Open Accessible Medical Research, Nov. 22, 2012, pp. 1-9.
Bravo-Escobar et al., "Effectiveness and safety of a home-based cardiac rehabilitation programme of mixed surveillance in patients with ischemic heart disease at moderate cardiovascular risk: A randomised, controlled clinical trial," BMC Cardiovascular Disorders, 2017, pp. 1-11, vol. 17:66.
Thomas et al., "Home-Based Cardiac Rehabilitation," Circulation, 2019, pp. e69-e89, vol. 140.
Thomas et al., "Home-Based Cardiac Rehabilitation," Journal of the American College of Cardiology, Nov. 1, 2019, pp. 133-153, vol. 74.
Thomas et al., "Home-Based Cardiac Rehabilitation," HHS Public Access, Oct. 2, 2020, pp. 1-39.
Dittus et al., "Exercise-Based Oncology Rehabilitation: Leveraging the Cardiac Rehabilitation Model," Journal of Cardiopulmonary Rehabilitation and Prevention, 2015, pp. 130-139, vol. 35.
Chen et al., "Home-based cardiac rehabilitation improves quality of life, aerobic capacity, and readmission rates in patients with chronic heart failure," Medicine, 2018, pp. 1-5 vol. 97:4.
Lima de Melo Ghisi et al., "A systematic review of patient education in cardiac patients: Do they increase knowledge and promote health behavior change?," Patient Education and Counseling, 2014, pp. 1-15.
Fang et al., "Use of Outpatient Cardiac Rehabilitation Among Heart Attack Survivors—20 States and the District of Columbia, 2013 and Four States, 2015," Morbidity and Mortality Weekly Report, vol. 66, No. 33, Aug. 25, 2017, pp. 869-873.
Beene et al., "AI and Care Delivery: Emerging Opportunities for Artificial Intelligence to Transform How Care Is Delivered," Nov. 2019, American Hospital Association, pp. 1-12.
Jennifer Bresnick, "What is the Role of Natural Language Processing in Healthcare?", pp. 1-7, published Aug. 18, 2016, retrieved on Feb. 1, 2022 from https://healthitanalytics.com/ featu res/what-is-the-role-of-natural-language-processing-in-healthcare.
Alex Bellec, "Part-of-Speech tagging tutorial with the Keras Deep Learning library," pp. 1-16, published Mar. 27, 2018, retrieved on Feb. 1, 2022 from https://becominghuman.ai/part-of-speech-tagging-tutorial-with-the-keras-deep-learning-library-d7f93fa05537.
Kavita Ganesan, All you need to know about text preprocessing for NLP and Machine Learning, pp. 1-14, published Feb. 23, 2019, retrieved on Feb. 1, 2022 from https:// towardsdatascience.com/all-you-need-to-know-about-text-preprocessing-for-nlp-and-machine-learning-bcl c5765ff67.
Badreesh Shetty, "Natural Language Processing (NPL) for Machine Learning," pp. 1-13, published Nov. 24, 2018, retrieved on Feb. 1, 2022 from https://towardsdatascience. com/natural-language-processing-nlp-for-machine-learning-d44498845d5b.
Boulanger Pierre et al., "A Low-cost Virtual Reality Bike for Remote Cardiac Rehabilitation", Dec. 7, 2017, Advances in Biometrics: International Conference, ICB 2007, Seoul, Korea, pp. 155-166.
Yin Chieh et al., "A Virtual Reality-Cycling Training System for Lower Limb Balance Improvement", BioMed Research International, vol. 2016, pp. 1-10.

(56) References Cited

OTHER PUBLICATIONS

Ruiz Ivan et al., "Towards a physical rehabilitation system using a telemedicine approach", Computer Methods in Biomechanics and Biomedical Engineering: Imaging & Visualization, vol. 8, No. 6, Jul. 28, 2020, pp. 671-680, XP055914810.
De Canniere Helene et al., "Wearable Monitoring and Interpretable Machine Learning Can Objectively Track Progression in Patients during Cardiac Rehabilitation", Sensors, vol. 20, No. 12, Jun. 26, 2020, XP055914617, pp. 1-15.
International Search Report and Written Opinion for PCT/US2023/014137, dated Jun. 9, 2023, 13 pages.
Website for "Esino 2022 Physical Therapy Equipments Arm Fitness Indoor Trainer Leg Spin Cycle Machine Exercise Bike for Elderly," https://www.made-in-china.com/showroom/esinogroup/product-detailYdZtwGhCMKVR/China-Esino-2022-Physical-Therapy-Equipments-Arm-Fitness-Indoor-Trainer-Leg-Spin-Cycle-Machine-Exercise-Bike-for-Elderly.html, retrieved on Aug. 29, 2023, 5 pages.
Abedtash, "An Interoperable Electronic Medical Record-Based Platform for Personalized Predictive Analytics", ProQuest LLC, Jul. 2017, 185 pages.
Jeong et al., "Remotely controlled biking is associated with improved adherence to prescribed cycling speed," Technology and Health Care 23, 2015, 7 pages.
Laustsen et al., "Telemonitored exercise-based cardiac rehabilitation improves physical capacity and health-related quality of life," Journal of Telemedicine and Telecare, 2020, DOI: 10.1177/1357633X18792808, 9 pages.
Blasiak et al., "CURATE.AI: Optimizing Personalized Medicine with Artificial Intelligence," SLAS Technology: Translating Life Sciences Innovation, 2020, 11 pages.
Abidi, Samina; A Knowledge-Modeling Approach to Integrate Multiple Clinical Practice Guidelines to Provide Evidence-Based Clinical Decision Support for Managing Comorbid Conditions; Journal of Medical Systems 41.12: 1-19. Springer Nature B.V. (Dec. 2017) (Year: 2017).
Fuller, Carole G.; Diagnosis and treatment considerations with comorbid developmentally disabled populations; Journal of Clinical Psychology 54.1: 1-10. John Wiley and Sons Inc. (Han. 1998) (Year: 1998).
He, Jianxing et al. The practical implemenatation of artificial intelligence technologies in medicine. Nature Medicine; New York vol. 25, Iss. 1. Jan. 2019. (Year: 2019).
cG. Acampora, D. J. Cook, P. Rashidi and A. V. Vasilakos, "A Survey on Ambient Intelligence in Healthcare," in Proceedings of the IEEE, vol. 101, vol. 101, No. 12, pp. 2470-2494, Dec. 2013, doi: 10.1109/JPROC.2013.2262913. (Year: 2013).
H. Demirkan, "A Smart Healthcare Systems Framework," in IT Professional, vol. 15, No. 5, pp. 38-45, Sep.-Oct. 2013, doi: 10.1109/MITP.2013.35. (Year: 2013).
W. Rashawn, J. Fowler and A. Arisha, "A Multi-Method Scheduling Framework for Medical Staff," 2018 Winter Simulation Conference (WSC), Gothenburg, Sweden, 2018, pp. 1464-1475, doi: 10.1109/WSC.2018.8632247. (Year: 2018).

* cited by examiner 20, 120

PERSUASIVE MOTIVATION FOR ORTHOPEDIC TREATMENT

CROSS-REFERENCES TO RELATED APPLICATIONS

This application is a continuation of U.S. patent application Ser. No. 17/075,508 filed Oct. 20, 2020, titled "Persuasive Motivation for Orthopedic Treatment," which claims priority to and the benefit of U.S. Provisional Application Patent Ser. No. 62/923,829 filed Oct. 21, 2019, titled "Persuasive Motivation for Orthopedic Treatment," the entire disclosure of which is hereby incorporated by reference for all purposes.

BACKGROUND

Patients may use treatment apparatuses for any suitable purpose, such as rehabilitation of a body part, pre-habilitation of a body part, strengthening a body part, exercising a body part, and the like.

SUMMARY

A method is disclosed. The method includes, while the patient uses the treatment apparatus, controlling, based on a treatment plan for a patient, a treatment apparatus. The method includes receiving, by a processing device, data from an electronic device, wherein the data comprises one of a position of a body part of the patient or a force exerted by the body part. The method includes storing, via the processing device, the data for the patient in a computer-readable medium. The method includes causing, via a processing device, presentation of a user interface on a patient interface. The user interface comprises an adjustment confirmation control, and the adjustment confirmation control is configured to solicit a response regarding the patient's comfort level with the one of the position of the body part or the force exerted by the body part.

A computer-implemented system for physical rehabilitation is provided. The computer-implemented system comprises a clinician interface including a patient profile display configured to present data regarding performance, by a patient, of a regimen for a body part, the body part comprising at least one of a joint, a bone, or a muscle group. The computer-implemented system also comprises a sensor configured to measure one of a position of the body part or a force exerted by the body part. The computer-implemented system also comprises a patient interface including an output device and an input device for communicating information regarding the performance of the regimen, respectively to and from the patient. The patient interface is configured to present instructions and status information to the patient regarding the performance of the regimen. The patient interface is configured to present an adjustment confirmation control configured to solicit a response regarding the patient's comfort or discomfort with the one of the position of the body part or the force exerted by the body part.

A system for remote treatment is also provided. The system for remote treatment comprises: a clinician interface configured to present controls for modifying a treatment plan comprising a regimen for treatment of a body part of a patient, with the body part comprising at least one of a joint, a bone, or a muscle group. The system also comprises a treatment apparatus for performing the regimen upon the body part, the treatment apparatus is configured to be manipulated by the patient. The system also comprises a patient interface including an output device and an input device for communicating information regarding the performance of the regimen, respectively to and from the patient. The patient interface and the treatment apparatus are each configured to enable operation from a patient location geographically separate from a location of the clinician interface. The patient interface is configured to present an adjustment confirmation control configured to solicit a response regarding the patient's comfort level with one of a position of the body part or a force exerted by the body part.

A patient user interface generated by a computer is also provided. The patient user interface comprises a session period action screen configured to present real-time status of a measurement regarding a patient's use of a treatment apparatus for performing a regimen for a body part, the body part comprising at least one of a joint, a bone, or a muscle group. The patient user interface also comprises an adjustment confirmation control configured to solicit a response regarding the patient's comfort level with one of a position of the body part or a force exerted by the body part. The measurement regarding the patient's use of the treatment apparatus includes the one of the position of the body part or the force exerted by the body part.

BRIEF DESCRIPTION OF THE DRAWINGS

For a detailed description of example embodiments, reference will now be made to the accompanying drawings in which.

NOTATION AND NOMENCLATURE

Figure 1:
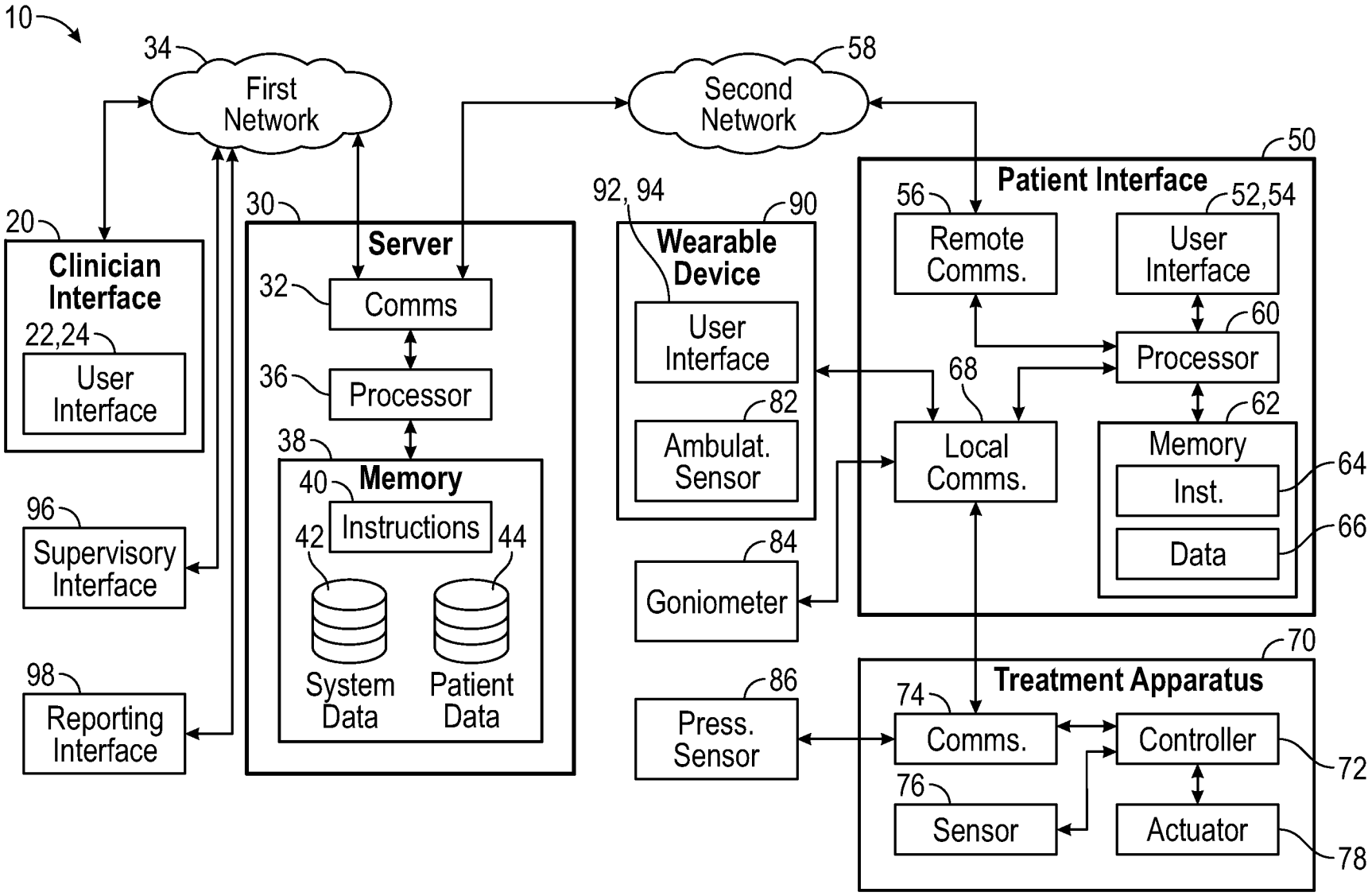
FIG. 1 shows a block diagram of an embodiment of a computer implemented system for managing a treatment plan.

Various terms are used to refer to particular system components. Different companies may refer to a component by different names—this document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

The terminology used herein is for the purpose of describing particular example embodiments only, and is not intended to be limiting. As used herein, the singular forms "a," "an," and "the" may be intended to include the plural forms as well, unless the context clearly indicates otherwise. The method steps, processes, and operations described herein are not to be construed as necessarily requiring their performance in the particular order discussed or illustrated, unless specifically identified as an order of performance. It is also to be understood that additional or alternative steps may be employed.

The terms first, second, third, etc. may be used herein to describe various elements, components, regions, layers and/or sections; however, these elements, components, regions, layers and/or sections should not be limited by these terms. These terms may be only used to distinguish one element, component, region, layer, or section from another region, layer, or section. Terms such as "first," "second," and other numerical terms, when used herein, do not imply a sequence or order unless clearly indicated by the context. Thus, a first element, component, region, layer, or section discussed below could be termed a second element, component, region, layer, or section without departing from the teachings of the example embodiments. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C. In another example, the phrase "one or more" when used with a list of items means there may be one item or any suitable number of items exceeding one.

Spatially relative terms, such as "inner," "outer," "beneath," "below," "lower," "above," "upper," "top," "bottom," and the like, may be used herein. These spatially relative terms can be used for ease of description to describe one element's or feature's relationship to another element(s) or feature(s) as illustrated in the figures. The spatially relative terms may also be intended to encompass different orientations of the device in use, or operation, in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptions used herein interpreted accordingly.

DETAILED DESCRIPTION

The following discussion is directed to various embodiments of the disclosure. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

FIG. 1 shows a block diagram of a computer-implemented system 10, hereinafter called "the system" for managing a treatment plan. The treatment plan includes one or more treatment protocols, and each treatment protocol includes one or more sessions. Each session comprises several session periods, with each session period including a particular activity for treating the body part of the patient. For example, a treatment plan for post-operative rehabilitation after a knee surgery may include an initial treatment protocol with twice daily stretching sessions for the first 3 days after surgery and a more intensive treatment protocol with active exercise sessions performed 4 times per day starting 4 days after surgery.

The system 10 includes a clinician interface 20 for a clinician, such as a doctor, a nurse, a physical therapist, or a technician, to use to review and to configure various aspects of a treatment plan for use in treating a patient. The clinician interface 20 includes a clinician input device 22 and a clinician display 24, which may be collectively called a clinician user interface 22, 24. The clinician input device 22 may include one or more of a keyboard, a mouse, a trackpad, or a touch screen, for example. Alternatively or additionally, the clinician input device 22 may include one or more microphones and voice-based functionalities, with hardware and/or software configured to interpret spoken instructions by the clinician by using the one or more microphones. The clinician input device 22 may include functionality provided by or similar to existing voice-based assistants such as Siri by Apple, Alexa by Amazon, Google Assistant, or Bixby by Samsung. The clinician input device 22 may include other hardware and/or software components. The clinician input device 22 may include one or more general purpose devices and/or special-purpose devices.

The clinician display 24 may take one or more different forms including, for example, a computer monitor or display screen on a tablet, smartphone, or a smart watch. The clinician display 24 may include other hardware and/or software components such as a projector, virtual reality capability, or augmented reality capability etc. The clinician display 24 may incorporate various different visual, audio, or other presentation technologies. For example, the clinician display 24 may include a non-visual display, such as an audio signal, which may include spoken language and/or other sounds such as tones, chimes, and/or melodies which may signal different conditions and/or directions. The clinician display 24 may comprise one or more different display screens presenting various data and/or interfaces or controls for use by the clinician. The clinician display 24 may include graphics, which may be presented by a web-based interface and/or by a computer program or application (App.).

The system 10 also includes a server 30 configured to store and to provide data related to managing the treatment plan. The server 30 may include one or more computers and may take the form of a distributed and/or virtualized computer or computers. In some embodiments, the server 30 may generate aspects of the clinician display 24 for presentation by the clinician interface 20. For example, the server 30 may include a web server configured to generate the display screens for presentation upon the clinician display 24. In some embodiments, the clinician display 24 may be configured to present a virtualized desktop that is hosted by the server 30. The server 30 also includes a first communication interface 32 configured to communicate with the clinician interface 20 via a first network 34. In some embodiments, the first network 34 may include a local area network (LAN), such as an Ethernet network. In some embodiments, the first network 34 may include the Internet, and communications between the server 30 and the clinician interface 20 may be secured via encryption, such as, for example, by using a virtual private network (VPN). In some embodiments, the first network 34 may include wired and/or wireless network connections such as Wi-Fi, Bluetooth, ZigBee, Near-Field Communications (NFC), cellular data network, etc. The server 30 includes a first processor 36 and a first machine-readable storage memory 38, which may be called a "memory" for short, holding first instructions 40 for performing the various actions of the server 30 for execution by the first processor 36. The server 30 is configured to store data regarding the treatment plan. For example, the memory 38 includes a system data store 42 configured to hold system data, such as data pertaining to treatment plans for treating one or more patients. The server 30 is also configured to store data regarding performance by a patient in following a treatment plan. For example, the memory 38 includes a patient data store 44 configured to hold patient data, such as data pertaining to the one or more patients, including data representing each patient's performance within the treatment plan.

The system 10 also includes a patient interface 50 configured to communicate information to a patient and to receive feedback from the patient. Specifically, the patient interface 50 includes an input device 52 and an output device 54, which may be collectively called a patient user interface 52, 54. The input device 52 may include one or more devices, such as a keyboard, a mouse, a touch screen input, a gesture sensor, and/or a microphone and processor configured for voice recognition. The output device 54 may take one or more different forms including, for example, a computer monitor or display screen on a tablet, smartphone, or a smart watch. The output device 54 may include other hardware and/or software components such as a projector, virtual reality capability, augmented reality capability, etc. The output device 54 may incorporate various different visual, audio, or other presentation technologies. For example, the output device 54 may include a non-visual display, such as an audio signal, which may include spoken language and/or other sounds such as tones, chimes, and/or melodies, which may signal different conditions and/or directions. The output device 54 may comprise one or more different display screens presenting various data and/or interfaces or controls for use by the patient. The output device 54 may include graphics, which may be presented by a web-based interface and/or by a computer program or application (App.).

As shown in FIG. 1, the patient interface 50 includes a second communication interface 56, which may also be called a remote communication interface configured to communicate with the server 30 and/or the clinician interface 20 via a second network 58. In some embodiments, the second network 58 may include a local area network (LAN), such as an Ethernet network. In some embodiments, the second network 58 may include the Internet, and communications between the patient interface 50 and the server 30 and/or the clinician interface 20 may be secured via encryption, such as, for example, by using a virtual private network (VPN). In some embodiments, the second network 58 may include wired and/or wireless network connections such as Wi-Fi, Bluetooth, ZigBee, Near-Field Communications (NFC), cellular data network, etc. In some embodiments, the second network 58 may be the same as and/or operationally coupled to the first network 34.

The patient interface 50 includes a second processor 60 and a second machine-readable storage memory 62 holding second instructions 64 for execution by the second processor 60 for performing various actions of patient interface 50. The second machine-readable storage memory 62 also includes a local data store 66 configured to hold data, such as data pertaining to a treatment plan and/or patient data, such as data representing a patient's performance within a treatment plan. The patient interface 50 also includes a local communication interface 68 configured to communicate with various devices for use by the patient in the vicinity of the patient interface 50. The local communication interface 68 may include wired and/or wireless communications. In some embodiments, the local communication interface 68 may include a local wireless network such as Wi-Fi, Bluetooth, ZigBee, Near-Field Communications (NFC), cellular data network, etc.

The system 10 also includes a treatment apparatus 70 configured to be manipulated by the patient and/or to manipulate a body part of the patient for performing activities according to the treatment plan. In some embodiments, the treatment apparatus 70 may take the form of an exercise and rehabilitation apparatus configured to perform and/or to aid in the performance of a rehabilitation regimen, which may be an orthopedic rehabilitation regimen, and the treatment includes rehabilitation of a body part of the patient, such as a joint or a bone or a muscle group. More specifically, the regimen may be a physical rehabilitation regimen for improving strength and/or range of motion of the body part. The body part may include, for example, a spine, a hand, a foot, a knee, or a shoulder. The body part may include a part of a joint, a bone, or a muscle group, such as one or more vertebrae or a ligament. As shown in FIG. 1, the treatment apparatus 70 includes a controller 72, which may include one or more processors, computer memory, and/or other components. The treatment apparatus 70 also includes a fourth communication interface 74 configured to communicate with the patient interface 50 via the local communication interface 68. The treatment apparatus 70 also includes one or more internal sensors 76 and an actuator 78, such as a motor. The actuator 78 may be used, for example, for moving the patient's body part and/or for resisting forces by the patient.

The internal sensors 76 may measure one or more operating characteristics of the treatment apparatus 70 such as, for example, a force a position, a speed, and/or a velocity. In some embodiments, the internal sensors 76 may include a position sensor configured to measure at least one of a linear motion or an angular motion of a body part of the patient. For example, an internal sensor 76 in the form of a position sensor may measure a distance that the patient is able to move a part of the treatment apparatus 70, where such distance may correspond to a range of motion that the patient's body part is able to achieve. In some embodiments, the internal sensors 76 may include a force sensor configured to measure a force applied by the patient. For example, an internal sensor 76 in the form of a force sensor may measure a force or weight the patient is able to apply, using a particular body part, to the treatment apparatus 70.

The system 10 shown in FIG. 1 also includes an ambulation sensor 82, which communicates with the server 30 via the local communication interface 68 of the patient interface 50. The ambulation sensor 82 may track and store a number of steps taken by the patient. In some embodiments, the ambulation sensor 82 may take the form of a wristband, wristwatch, or smart watch. In some embodiments, the ambulation sensor 82 may be integrated within a phone, such as a smartphone.

The system 10 shown in FIG. 1 also includes a goniometer 84, which communicates with the server 30 via the local communication interface 68 of the patient interface 50. The goniometer 84 measures a position of the patient's body part. More specifically, the goniometer 84 measures an angle of the body part, particularly where the body part is a joint. For example, the goniometer 84 may measure the angle of flex of a patient's knee or elbow or shoulder.

The system 10 shown in FIG. 1 also includes a pressure sensor 86, which communicates with the server 30 via the local communication interface 68 of the patient interface 50. The pressure sensor 86 measures an amount of pressure or weight applied by a body part of the patient. For example, pressure sensor 86 may measure an amount of force applied by a patient's foot when pedaling a stationary bike.

The system 10 also includes a wearable device 90 configured to be worn or carried on the patient's person. The wearable device 90 may take one of several different forms such as, for example, a smart watch, a wristband, a pendant, or a smartphone. The wearable device 90 may include a means of attachment, such as a pin, a belt clip, a strap, or a lanyard, to facilitate the device's being worn or carried by the patient. In some embodiments, and as shown in FIG. 1, the wearable device 90 includes the ambulation sensor 82. The wearable device 90 may include one or more other sensors, such as a heartrate sensor, a blood pressure sensor, or a pulse oximeter. The ambulation sensor 82 or another one of the sensors in the wearable device 90 may be configured to monitor one or more factors that indicate an activity level of the patient. The patient's activity level could be used to determine a quantity and/or quality of exercise performed by the patient. The patient's activity level could also be used to determine a quantity and/or quality of the patient's sleep.

The wearable device 90 includes a wearable input device 92 and a wearable display 94, which may be collectively called a wearable user interface 92, 94. The wearable input device 92 may include one or more devices, such as a keyboard, a mouse, a touch screen input, a gesture sensor, and/or a microphone and processor configured for voice recognition. The wearable display 94 may take one or more different forms including, for example, a display screen, and/or one or more lights or other indicators. The wearable display 94 may incorporate various different visual, audio, or other presentation technologies. For example, the wearable display 94 may include a non-visual display, such as a haptic or tactile device and/or an audio signal, which may include spoken language and/or other sounds such as tones, chimes, and/or melodies, and the non-visual display may signal different conditions and/or directions. The wearable display 94 may comprise one or more different display screens configured to present various data and/or interfaces or controls for use by the patient. The wearable display 94 may include graphics, which may be presented by a web-based interface and/or by a computer program or application (App.). The wearable user interface 92, 94 may be configured to present different types of information to the patient. For example, the wearable user interface 92, 94 may be configured to present a reminder when it is time for the patient to perform a rehabilitation session. The wearable user interface 92, 94 may allow the patient to track daily goals or to receive messages from a clinician, etc. This function of the wearable device 90 may be especially useful when the patient is away from the patient interface 50.

The system 10 shown in FIG. 1 also includes a supervisory interface 96 which may be similar or identical to the clinician interface 20. In some embodiments, the supervisory interface 96 may have enhanced functionality beyond what is provided on the clinician interface 20. The supervisory interface 96 may be configured for use by a person having responsibility for the treatment plan, such as an orthopedic surgeon.

The system 10 shown in FIG. 1 also includes a reporting interface 98 which may be similar or identical to the clinician interface 20. In some embodiments, the reporting interface 98 may have less functionality from what is provided on the clinician interface 20. For example, the reporting interface 98 may not have the ability to modify a treatment plan. Such a reporting interface 98 may be used, for example, by a biller to determine the use of the system 10 for billing purposes. In another example, the reporting interface 98 may not have the ability to display patient identifiable information, presenting only pseudonymized data and/or anonymized data for certain data fields concerning a data subject and/or for certain data fields concerning a quasi-identifier of the data subject. Such a reporting interface 98 may be used, for example, by a researcher to determine various effects of a treatment plan on different patients.

In some embodiments, the patient interface 50 and the treatment apparatus 70 are each configured to operate from a patient location geographically separate from a location of the clinician interface 20. For example, the patient interface 50 and the treatment apparatus 70 may be used as part of an in-home rehabilitation system, which may be monitored remotely by using the clinician interface 20 at a centralized location, such as a clinic or hospital. In some embodiments, either or both of the patient interface 50 and/or the treatment apparatus 70 are configured to communicate with a remote computer, such as the server 30, to receive the treatment plan and to report back to the remote computer with data regarding performance by the patient in following the treatment plan.

Figure 2:
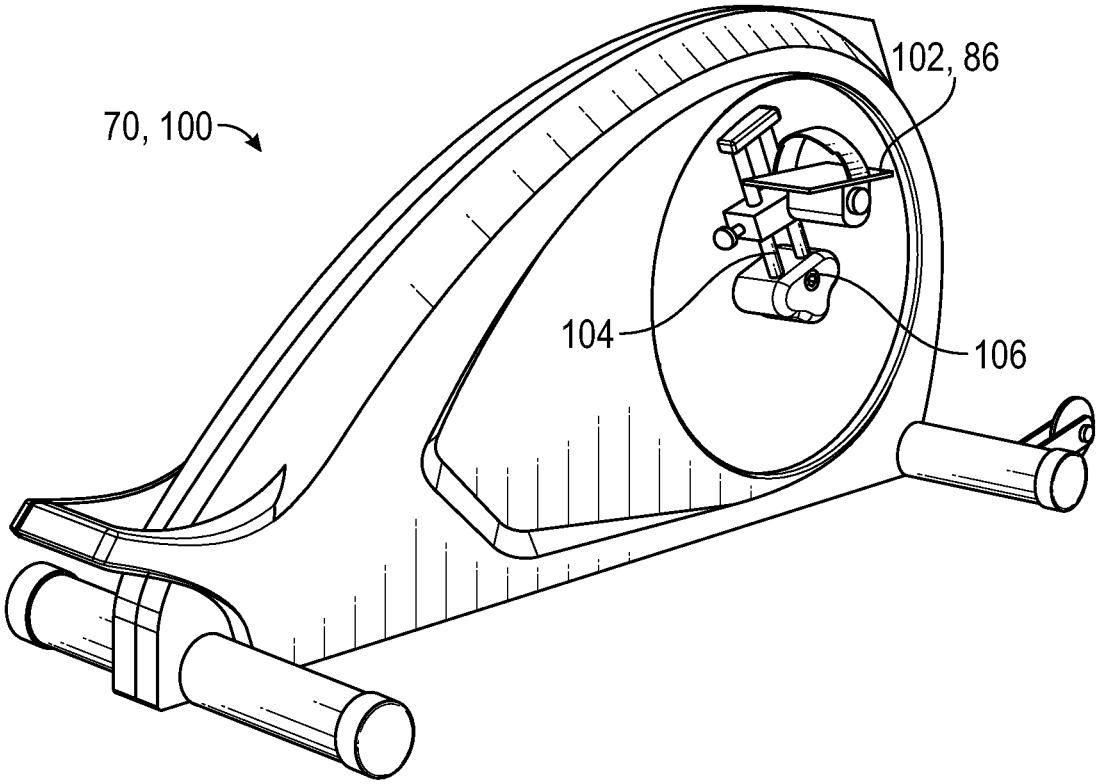
FIG. 2 shows a perspective view of an embodiment of a treatment apparatus.
Figure 3:
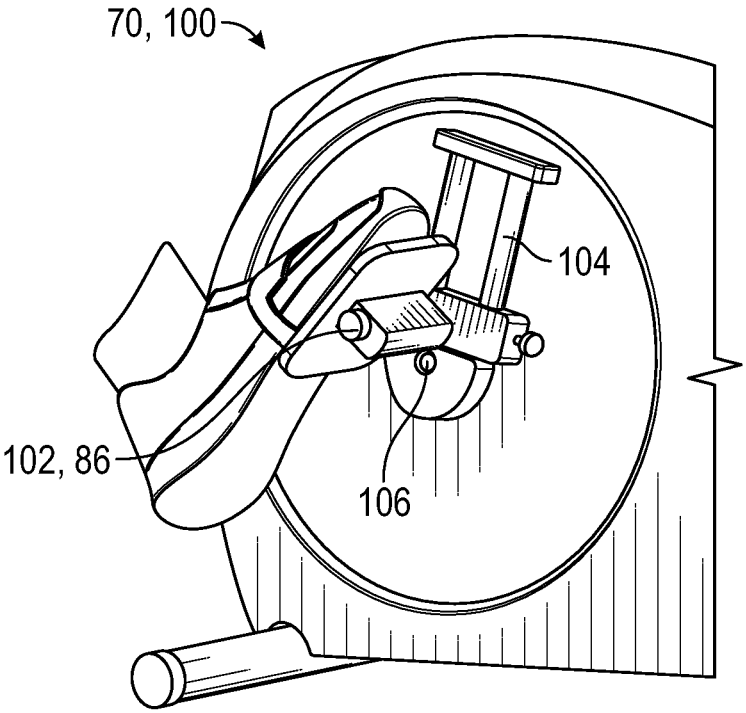
FIG. 3 shows a perspective view of a pedal of the treatment apparatus of FIG. 2.

FIGS. 2-3 show an embodiment of a treatment apparatus 70. More specifically, FIG. 2 shows a treatment apparatus 70 in the form of a stationary cycling machine 100, which may be called a stationary bike, for short. The stationary cycling machine 100 includes a set of pedals 102 each attached to a pedal arm 104 for rotation about an axle 106. In some embodiments, and as shown in FIG. 2, the pedals 102 are movable on the pedal arms 104 in order to adjust a range of motion used by the patient in pedaling. For example, the pedals being located inwardly toward the axle 106 corresponds to a smaller range of motion than when the pedals are located outwardly away from the axle 106. A pressure sensor 86 is attached to or embedded within one of the pedals 106 for measuring an amount of force applied by the patient on the pedal 106. The pressure sensor 86 may communicate wirelessly to the treatment apparatus 70 and/or to the patient interface 50.

Figure 4:
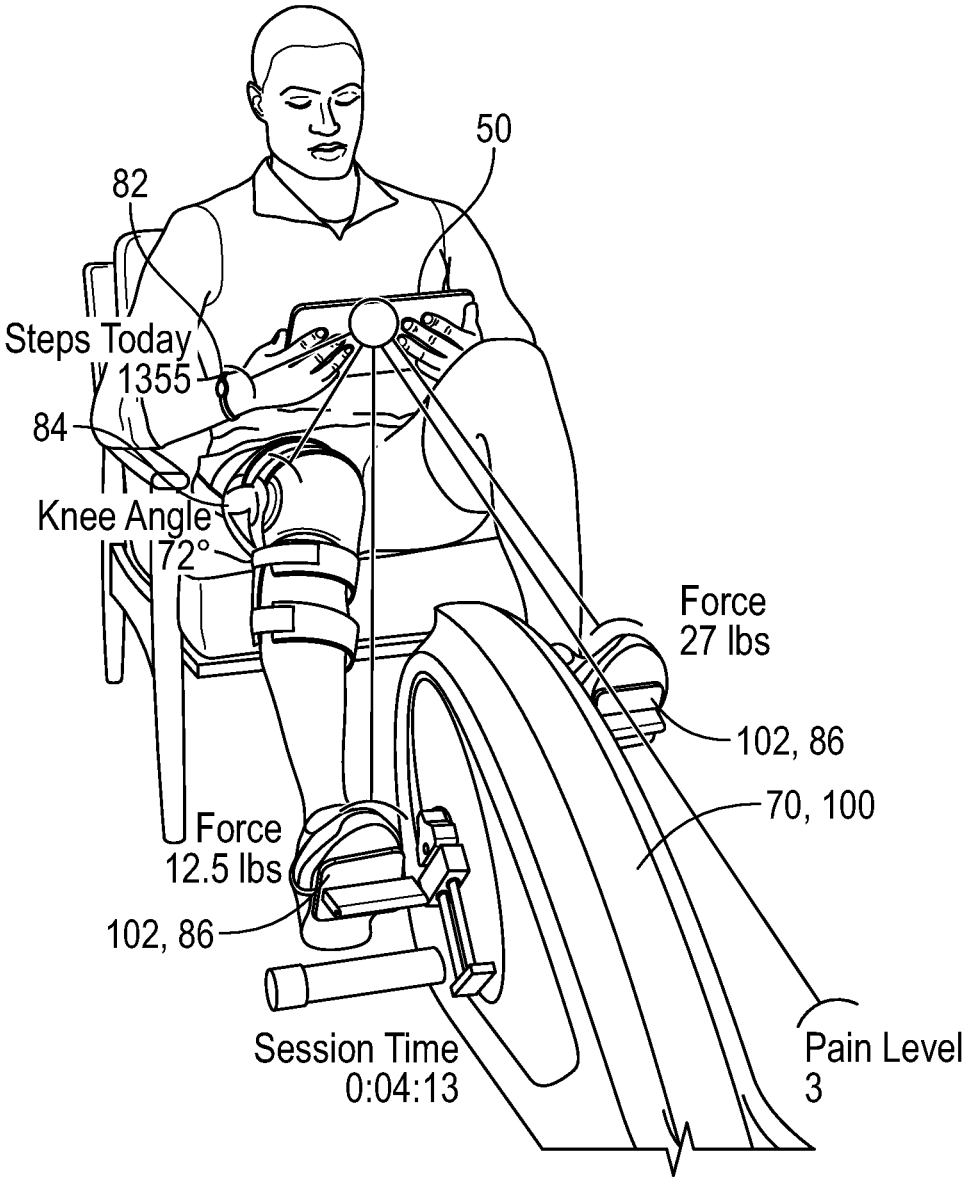
FIG. 4 shows a perspective view of a person using the treatment apparatus of FIG. 2.

FIG. 4 shows a person (a patient) using the treatment apparatus of FIG. 2, and showing sensors and various data parameters connected to a patient interface 50. The example patient interface 50 is a tablet computer or smartphone, or a phablet, such as an iPad, an iPhone, an Android device, or a Surface tablet, which is held manually by the patient. In some other embodiments, the patient interface 50 may be embedded within or attached to the treatment apparatus 70. FIG. 4 shows the patient wearing the ambulation sensor 82 on his wrist, with a note showing "STEPS TODAY 1355", indicating that the ambulation sensor 82 has recorded and transmitted that step count to the patient interface 50. FIG. 4 also shows the patient wearing the goniometer 84 on his right knee, with a note showing "KNEE ANGLE 72°", indicating that the goniometer 84 is measuring and transmitting that knee angle to the patient interface 50. FIG. 4 also shows a right side of one of the pedals 106 with a pressure sensor 86 showing "FORCE 12.5 lbs.," indicating that the right pedal pressure sensor 86 is measuring and transmitting that force measurement to the patient interface 50. FIG. 4 also shows a left side of one of the pedals 106 with a pressure sensor 86 showing "FORCE 27 lbs.", indicating that the left pedal pressure sensor 86 is measuring and transmitting that force measurement to the patient interface 50. FIG. 4 also shows other patient data, such as an indicator of "SESSION TIME 0:04:13", indicating that the patient has been using the treatment apparatus 70 for 4 minutes and 13 seconds. This session time may be determined by the patient interface 50 based on information received from the treatment apparatus 70. FIG. 4 also shows an indicator showing "PAIN LEVEL 3". Such a pain level may be obtained from the patent in response to a solicitation, such as a question, presented upon the patient interface 50.

Figure 5:
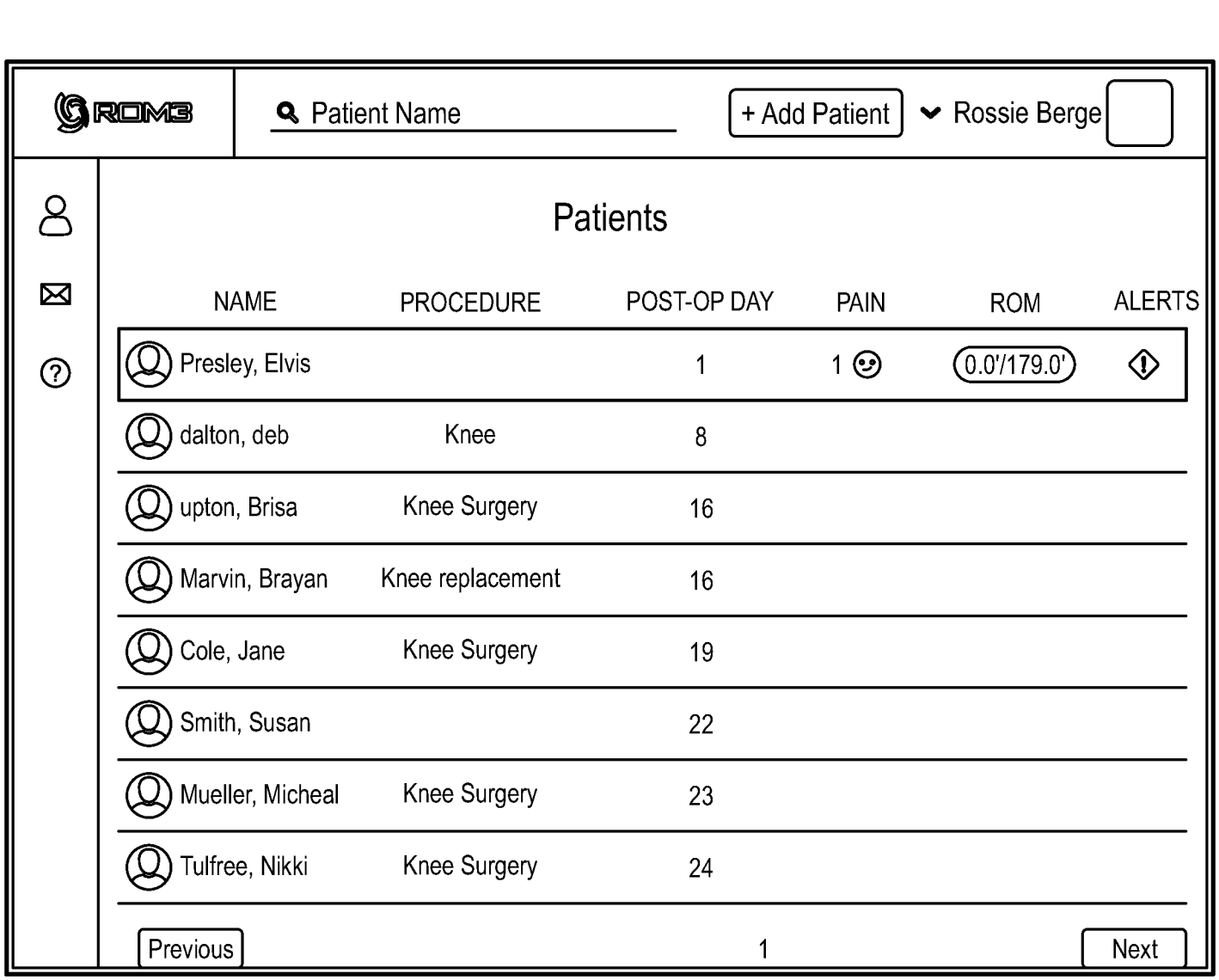
FIG. 5 shows an example embodiment of an overview display of a clinician interface.

FIG. 5 is an example embodiment of an overview display 120 of the clinician interface 20. Specifically, the overview display 120 presents summary information regarding each of a plurality of different patients. In some embodiments, and as shown on FIG. 5, the summary information includes an indicator showing a procedure performed upon each of the patients, temporal progress of the patient within the treatment plan (post-op day), an indicator of a last-reported pain level, range-of-motion (ROM) numbers, and an indicator showing if there are any alerts requiring special attention.

Figure 6:
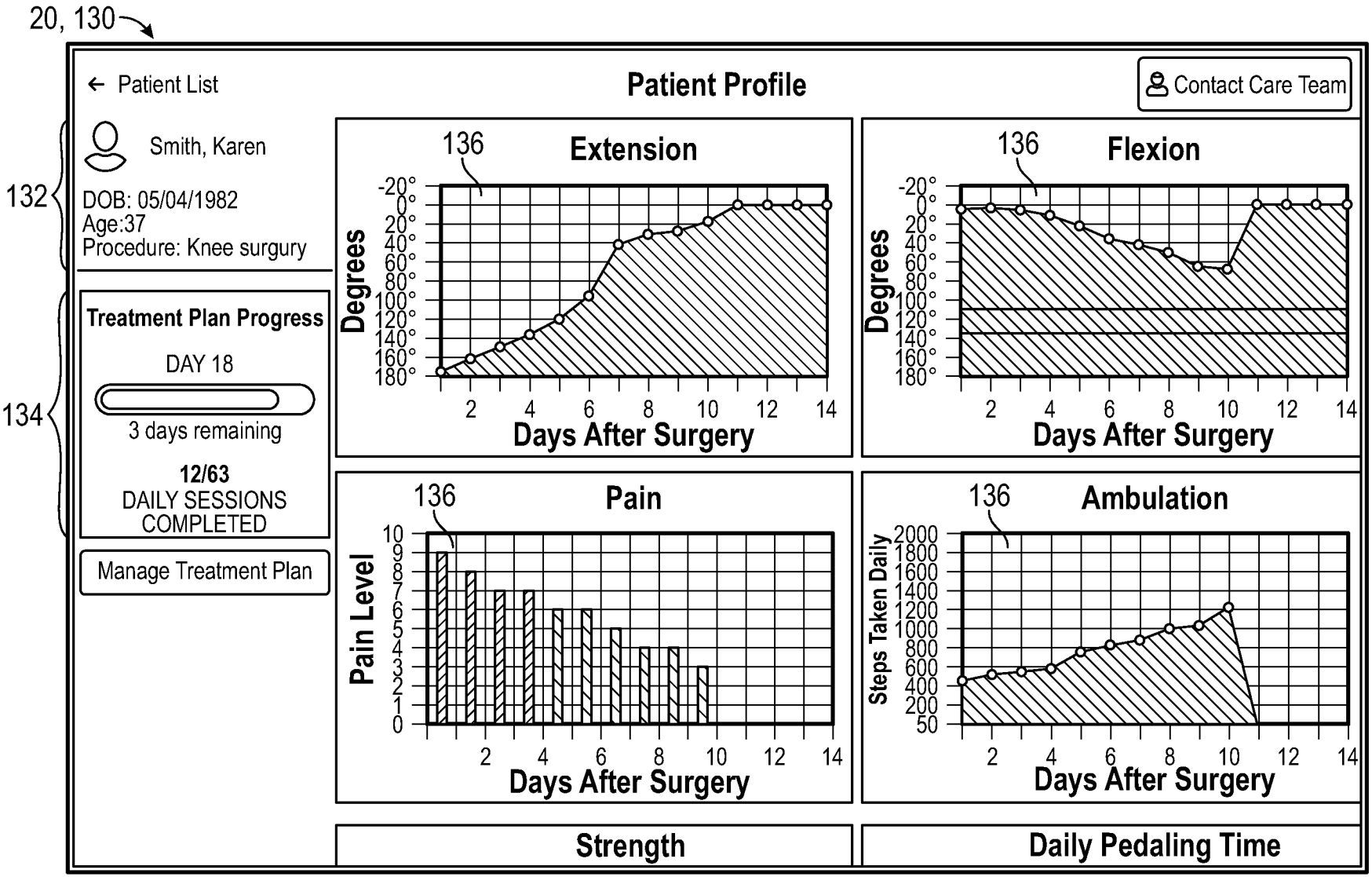
FIG. 6 shows an example embodiment of a patient profile display of a clinician interface.
Figure 7:
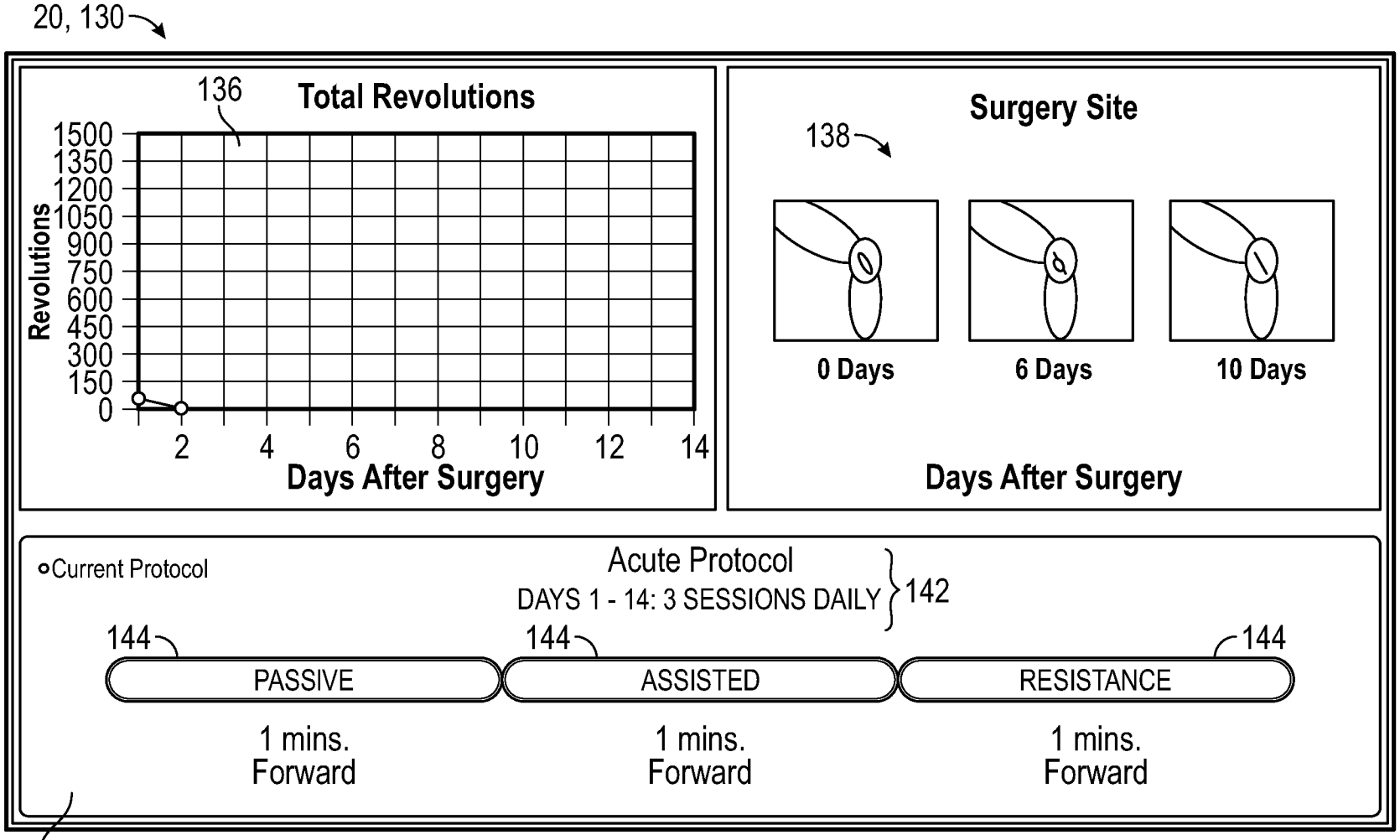
FIG. 7 shows another view of the example patient profile display of FIG. 6.

FIGS. 6-7 show an example embodiment of a patient profile display 130 of the clinician interface 20. The example patient profile display 130 includes a patient summary 132 with the patient's name, date of birth (DOB), age, a description of a procedure performed or to be performed on the patient, e.g., "Knee surgery", and a picture of the patient, if available. The example patient profile display 130 also includes a treatment progress summary 134, showing one or more indicators of progress within a treatment regimen or plan. The example treatment progress summary 134 shown on FIG. 6 includes textual progress summaries, "DAY 18", "3 days remaining", "12/63 DAILY SESSIONS COMPLETED", as well as graphical progress summaries in the form of horizontal bar graphs, which may also be called progress bars.

The example patient profile display 130 presents information regarding a treatment history of the patient. For example, the example patient profile display 130 includes a plurality of different treatment graphs 136 showing the effect of various treatment parameters over time. The treatment graphs 136 shown in the example patient profile display 130 of FIGS. 6-7 include extension (angle), flexion (angle), pain (0-10 scale), ambulation (steps/day), and total revolutions (i.e., revolutions performed on the stationary cycling machine 100). The patient profile display 130 shown on FIG. 7 also includes a pictorial history 138, showing one or more images of the surgical site for reference by a clinician or other healthcare professional in reviewing post-operative progress. The images in the pictorial history 138 may be taken by the patient and/or by a clinician or other healthcare professional. For example, the first picture may be taken by a member of the surgical staff, and subsequent pictures may be taken by the patient and/or the rehabilitation clinician. The example patient profile display 130 shown on FIG. 7 also includes a protocol summary display 140 showing a summary overview of a treatment protocol to be performed by the patient. The example protocol summary display 140 includes a protocol heading 142 with a protocol name, e.g. "Acute Protocol." The protocol heading 142 also includes overview information regarding how and when the protocol is to be performed, e.g. "Days 1-14, 3 sessions daily." The protocol summary display 140 also includes several protocol session icons 144, each indicating details of an activity to be performed within a protocol session, e.g., "Passive", "Active", or "Resistance", together with other information regarding the protocol session, such as a direction (forward/reverse), and an amount of time that each protocol session is prescribed to be performed.

Figure 8:
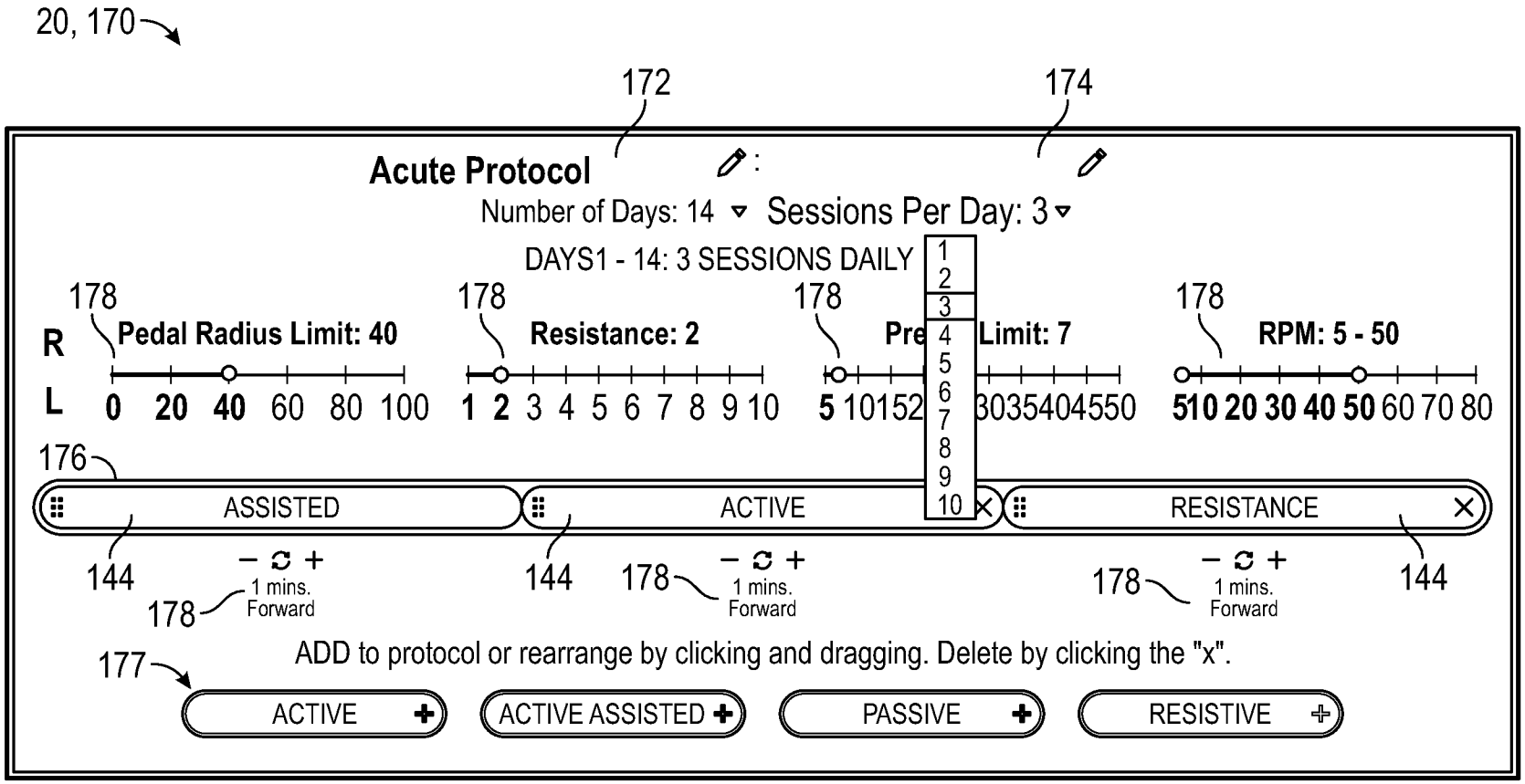
FIG. 8 shows an example embodiment of a treatment protocol management display of a clinician interface.

FIG. 8 shows an example embodiment of a protocol management display 170 of a clinician interface 20 for editing a treatment protocol 156. Specifically, the protocol management display 170 includes a protocol name control 172 for renaming the treatment protocol 156. The protocol management display 170 also includes a protocol timing control 174 for adjusting various timing settings of the treatment protocol 156, such as a duration for the treatment protocol 156 within the treatment plan 152, and a number of sessions to be performed per day. The example protocol timing control 174 shown on FIG. 8 includes drop-down menus for changing the various timing settings, but other controls could be used such as, for example, numeric entry fields or increase/decrease buttons. The protocol management display 170 also includes a protocol session control 176 for customizing the session periods. Specifically, the protocol session control 176 includes a graphical representation of a session, with protocol session icons 144, which may be similar or identical to the protocol session icons 144 of the protocol summary display 140. Each session period may have an associated type, such as passive, resistance, assisted, or active. Each session period may also have several parameters associated therewith.

The protocol session control 176 allows the clinician to adjust the number, the order, and the types of the session periods within a given session of the treatment protocol 156. Each session period has a type that corresponds to a category of activity to be performed upon a body part during that session period. For example, the session periods may be one of a passive period, an assisted period, an active period, or a resistance period. Each passive period is associated with a particular activity that includes moving a body part by an external force; each assisted period is associated with a particular activity that includes moving the body part by the patient with assistance of the external force; each active period is associated with a particular activity that includes the patient moving the body part without assistance of the external force; and each resistance period is associated with a particular activity that includes the patient actively moving the body part against a resistance force. For example, where the treatment apparatus 70 includes a stationary cycling machine 100, a passive period may include an actuator 78, such as a motor, that rotates the pedals 108 with the patient's feet and legs attached thereto and without any action or force being applied by the patient. An assisted period may include the patient applying force to rotate the pedals 108 with some additional help or assistance from the actuator 78. An active period may include the patient applying force to rotate the pedals 108 without any assistance from any outside force. A resistance period may include the patient exerting some force to rotate the pedals 108 in opposition to a resistance force applied by the actuator 78. In some embodiments, the actuator 78 may produce the external forces for each of the different categories of the session periods. The external forces may have different attributes, such as directions, intensities, or rates of changes, for each of the different categories of the session periods. Each session may include any number of session periods in any combination.

In some embodiments, the protocol session icons 144 may be modified using a drag-and-drop interface. Additional protocol sessions may be added to the protocol session using a session period control 177. Additionally, parameters for any or all of the session periods may be adjusted using various session parameter controls 178. For example, a duration and direction of each session period may be adjusted using the session parameter controls 178 located below an associated one of the protocol session icons 144. Various other parameters, such as resistance, target speed range (RPM), pedal radius limits, etc. may be adjusted using other session parameter controls 178. In some embodiments, the number and the type of session parameter controls 178 may change depending on the type of session period selected. For example, selecting a protocol session icon 144 for an active type of session period may cause the target speed range (RPM) session parameter control 178 to be visible and adjustable, but the target speed range (RPM) session parameter control 178 may not be visible and/or adjustable in response to selecting a protocol session icon 144 for a passive type session.

In some embodiments, the system 10 may impose limits on values that can be set using the session parameter controls 178. For example, the treatment plan 154 may include a maximum session time. In some embodiments, to satisfy a rule of the system 10 or a rule within the treatment plan 154, one or more of the values of the parameters may be automatically changed by the system 10. For example, the treatment plan 154 may require a resistance type of session period after an active type of session period, wherein the former is at least 25% as long as the active type of session to allow the patient to cool down after active exercise. The system 10 may automatically create the resistance type session period in response to the clinician creating an active type session period. The system 10 may also automatically adjust the time of the resistance type session period to satisfy the requirement of it lasting at least 25% as long as the active type of session.

In some embodiments, the treatment plan 154 may include maximum values for certain parameters until an associated condition is satisfied. For example, the pedal radius limit may be limited to 40 mm until an associated condition is satisfied. Associated conditions may include, for example, approval by an authorized person, such as an orthopedic surgeon; the elapsing of a particular time, such as 5 days after a surgical procedure; or successful completion of a post-operation checkup. Similarly, the treatment plan 154 may place limits on the types of session periods that may be performed until an associated condition is satisfied. The treatment plan 154 may be limited to only passive or assisted session periods (and not active periods or resistance periods until an associated condition is satisfied. Different associated conditions may be associated with each of the different parameters and/or with limits on the types of session periods available.

Figure 9:
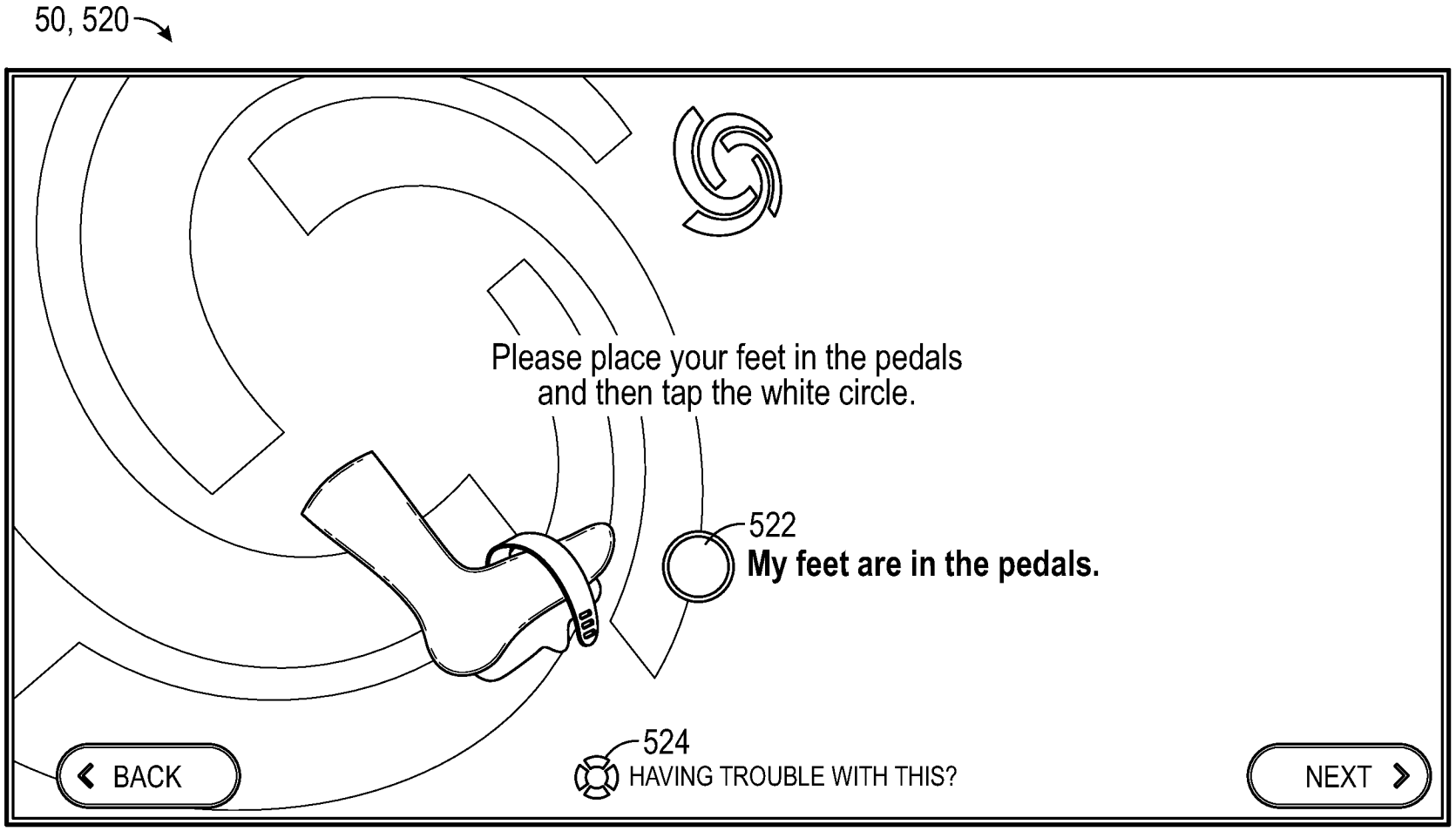
FIG. 9 shows an example embodiment of a positioning confirmation screen of a patient interface.

FIG. 9 shows an example embodiment of positioning confirmation screen 520 of the patient interface 50. This screen 520 is the beginning of a guided walk-through for the patient to use the treatment apparatus 70. Specifically, this screen 520 includes written instructions to guide the patient in placing their feet in the pedals 102 of a stationary cycling machine 100. In some embodiments, this screen 520 may include graphics, such as pictures or animations to help the patient perform particular actions for using the treatment apparatus 70. Screen 520 includes a position confirmation selector 522 for the patient to indicate that they are in position to use the treatment apparatus 70. Screen 520 also includes a trouble button 524 for the patient to indicate that they are having trouble getting in position to use the treatment apparatus 70.

Figure 10:
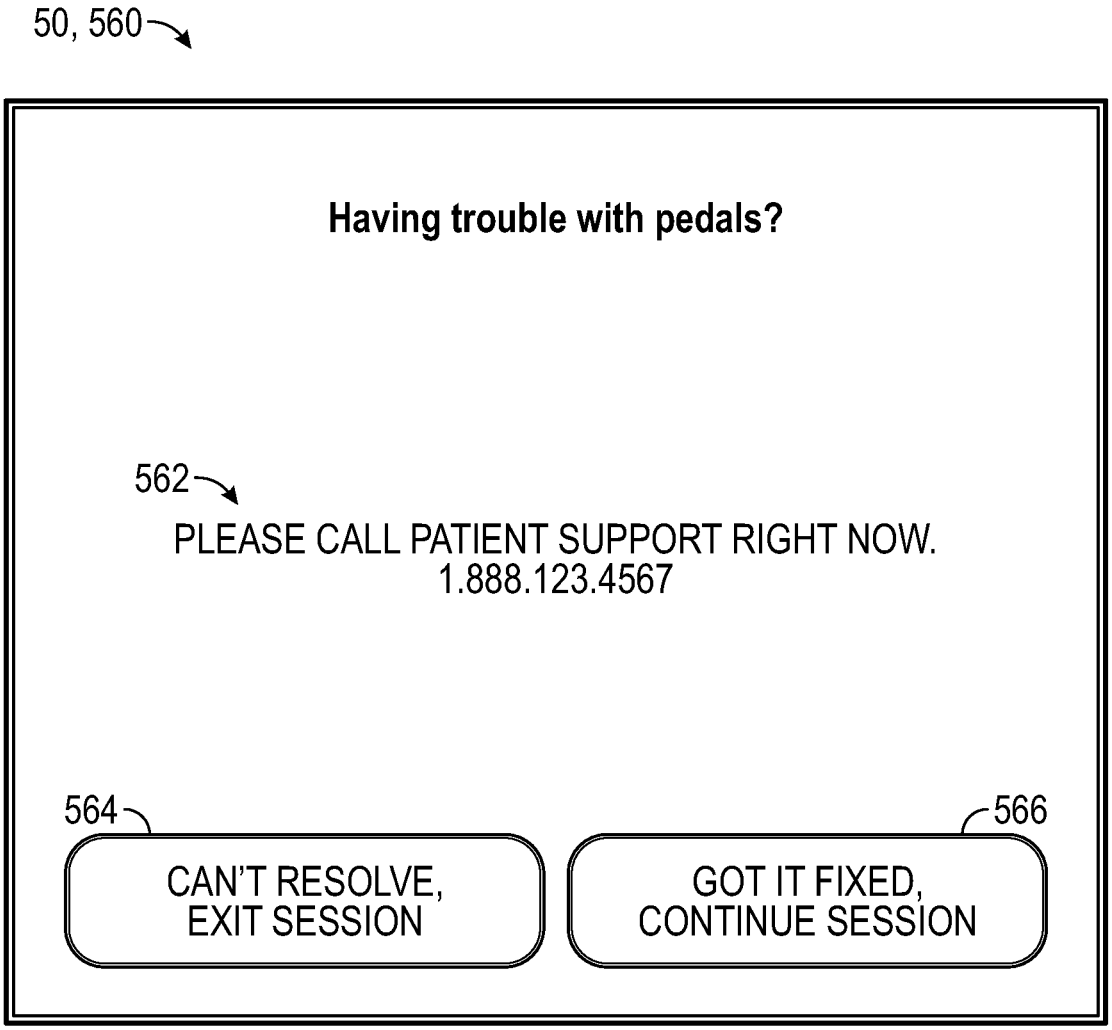
FIG. 10 shows an example embodiment of a positioning help screen of a patient interface.

FIG. 10 shows an example embodiment of a positioning help screen 560 of the patient interface 50. This help screen 560 may be shown in response to the user selecting the trouble button 524 on the positioning confirmation screen 520. The help screen 560 may automatically be displayed if the patient fails to select the position confirmation selector 522 within a predetermined period of time. In some embodiments, an intermediate screen such as a popup asking if the patient needs more time may be displayed before the help screen 560 is shown. The help screen 560 includes assistance instructions 562 for the patient to obtain assistance for using the treatment apparatus 70. In some embodiments, the assistance instructions 562 may include a phone number. The assistance instructions 562 may also include other items, such as a link to a video conference with someone able to help the patient, and/or a link to a video or animated walk-through with detailed instructions for performing a particular action to use the treatment apparatus 70. The particular action may include, for example, placing the feet in the pedals. The help screen 560 may also include an exit button 564 that the patient can use to stop the treatment session in case they are unable to resolve their issue with using the treatment apparatus 70. Use of the exit button 564 may generate an alert to the clinician. The help screen 560 also includes a proceed button 566 that the patient can use to indicate that they have resolved their issue and are able to proceed with the treatment session.

Figure 11:
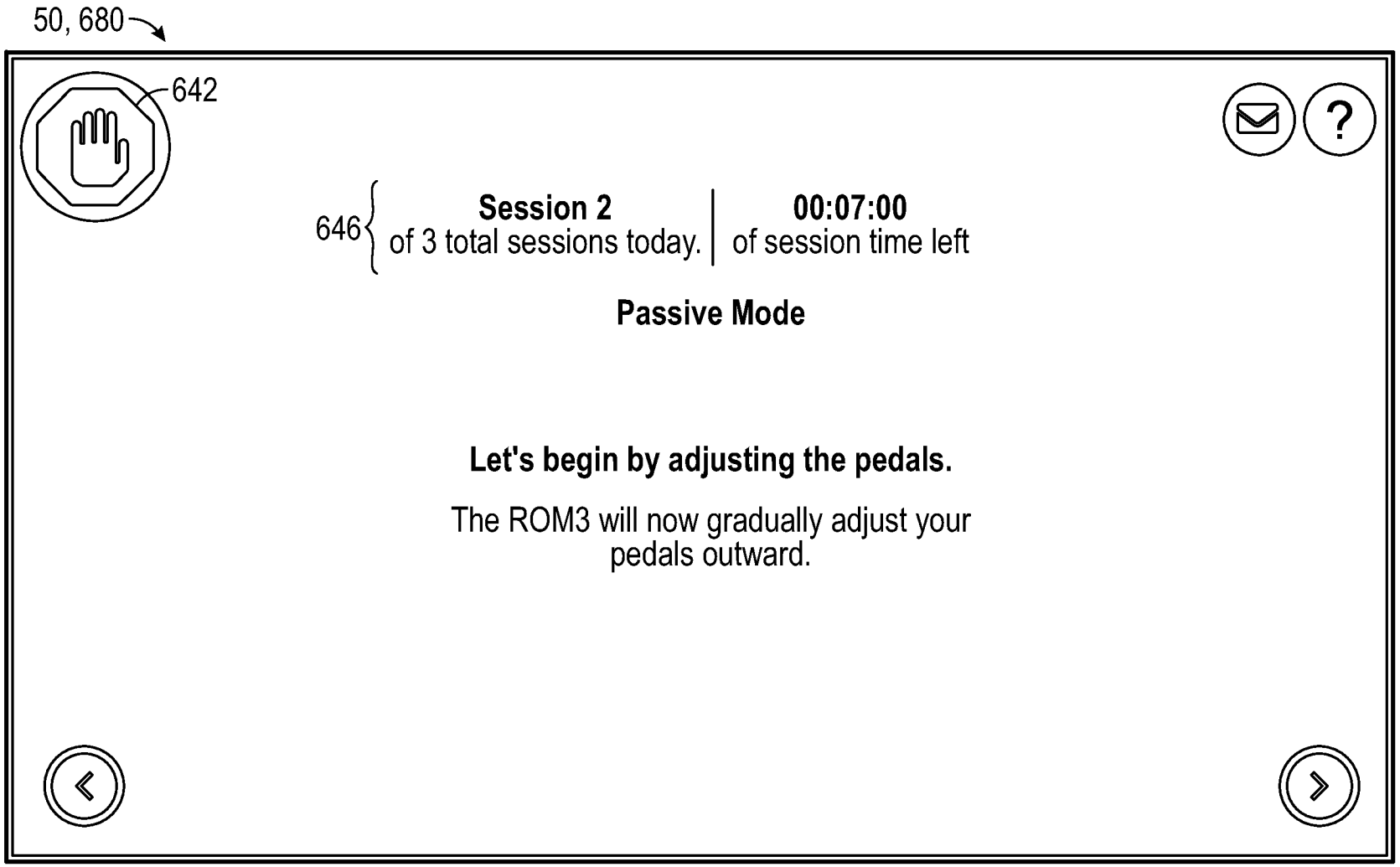
FIG. 11 shows an example embodiment of an adjustment introduction screen of a patient interface.

FIG. 11 shows an example embodiment of an adjustment introduction screen 680 of the patient interface 50. The adjustment introduction screen 680 includes text and/or graphics indicating various adjustments to be performed by the treatment apparatus 70. In the example shown, the adjustments include the treatment apparatus 70 that is a stationary cycling machine 100 that automatically moves the pedals 102 outwardly to a predetermined position for the session period.

In some embodiments, the patient interface 50 presents an adjustment confirmation control configured to solicit a response regarding the patient's comfort level with the position of the body part or the force exerted by the body part. The comfort level may be indicated by a binary selection (e.g., comfortable or not comfortable). In some embodiments, the comfort level may be an analog value that may be indicated numerically or with an analog input control, such as a slider or a rotary knob. In some embodiments, the comfort level may be indicated by one of several different comfort level values, such as an integer number from 1 to 5. In some embodiments, the comfort level may be indicated using controls for the patient to maintain a setting or for the patient to change the setting. More specifically, the adjustment confirmation control for the patient to change the setting may provide for the patient to change the setting in either of two or more directions. For example, the controls may allow the patient to maintain the value of a setting, to increase the value of the setting, or to decrease the value of the setting.

In some embodiments, the patient interface 50 and/or a server may generate and/or present the adjustment confirmation control using one or more machine learning models. The one or more machine learning models may be trained using training data including inputs that are mapped to outputs, such that the machine learning models identify patterns in the data to generate a certain output. The training data may include input data of types and/or arrangements of graphical user interface elements to present that are associated with a higher likelihood of a patient providing feedback. The training data may include input data of values of comfort levels to present that are associated with a higher likelihood of a patient providing feedback. The training data may include input data of values of positions of body parts to present that are associated with a higher likelihood of a patient providing feedback.

Figure 12:
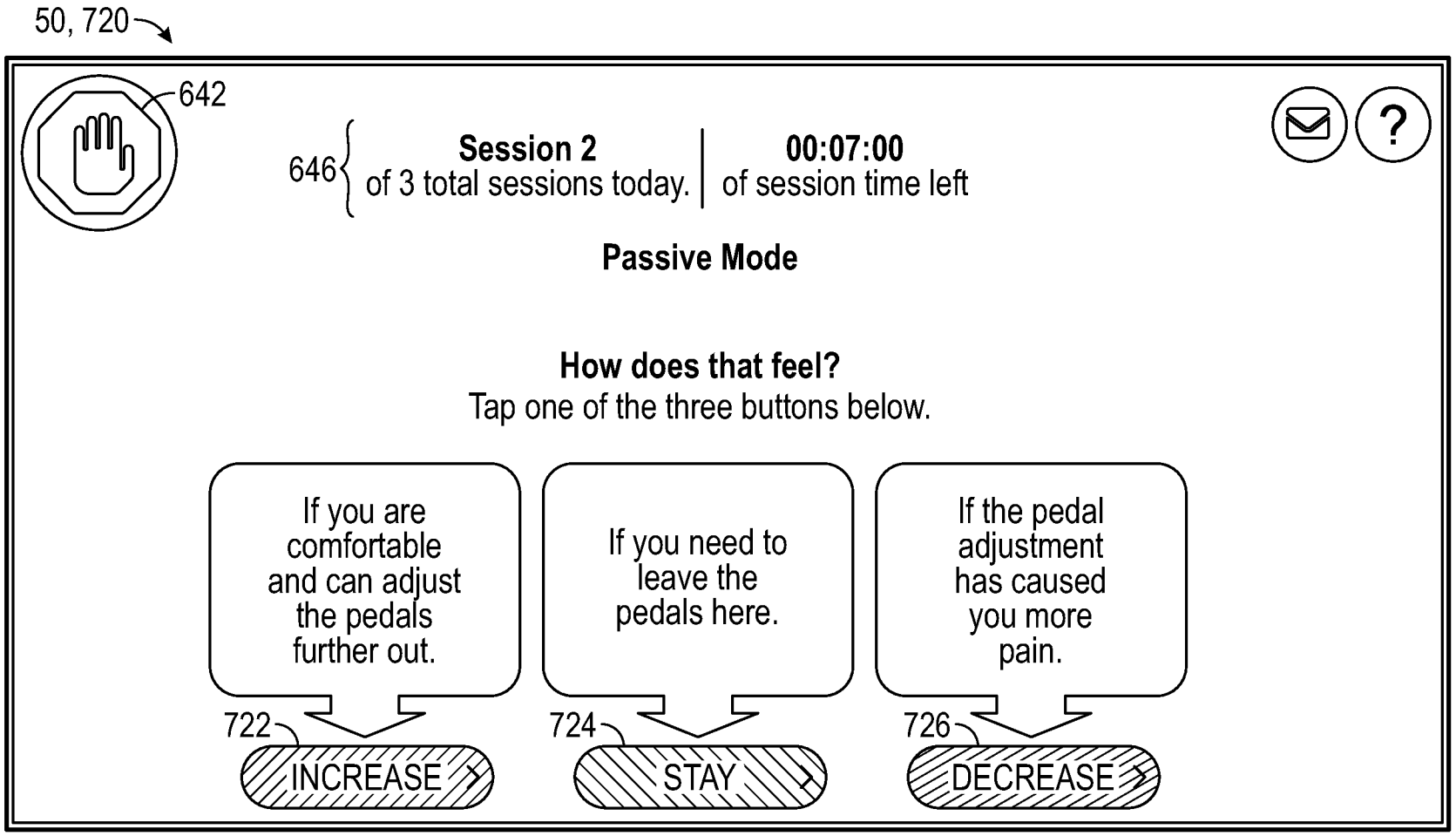
FIG. 12 shows an example embodiment of an adjustment confirmation screen of a patient interface.

The adjustment confirmation control may take the form of an adjustment confirmation screen 720, as shown, for example, in FIG. 12. The adjustment confirmation control may take other forms, such as a popup window or a portion of a larger display screen. The patient interface 50 may present the adjustment confirmation control on a graphical user interface, such as a display screen or an overlay or virtual control within a virtual reality (VR) or augmented reality (AR) display. Additionally or alternatively, the adjustment confirmation control may include one or more physical control devices, such as buttons, knobs, sliders, etc. In some embodiments, the adjustment confirmation control may be used in conjunction with an automatic adjustment, such as an actuator 78 within the treatment apparatus 70. For example, as shown in the FIGS., an actuator 78 may change the radius of one of the pedals 102, thus changing the position of the patient's knees. The adjustment confirmation control may then solicit a response regarding the patient's comfort or discomfort with the adjusted position. In another example, the patient interface 50 may prompt the patient to apply a target pressure, such as 50 lbs. The adjustment confirmation control may then solicit a response regarding the patient's comfort or discomfort in applying the target pressure.

The phrase "ICON" refers to 'increase control', the phrase "DCON" refers to 'decrease control', and the phrase "SCON" refers to 'stay control', unless explicitly stated otherwise, are intended to be understood as noun phrases meaning controls that serve the functions of increasing, decreasing, or maintaining corresponding values.

The adjustment confirmation screen 720 includes text and/or graphics requesting the patient to confirm their satisfaction with the position of the treatment apparatus 70 during and/or after the automatic adjustments are made. The adjustment confirmation screen 720 includes an increase control that the patient may select to indicate a desire to increase the value of a corresponding parameter. The corresponding parameter may be a position of the treatment apparatus 70 such as the radius of the pedal 102 on the pedal arm 104. The corresponding parameter may be a setting for a force or a speed of an exercise performed as part of the regimen. For example, the corresponding parameter may be a target pressure or a target RPM speed in a given session period. The increase control may take the form of an increase button 722, such as the button shown on FIG. 12. The increase control may take other forms, such as a knob or slider control, which may be a physical device or part of a graphical user interface. The adjustment confirmation screen 720 also includes a stay control that the patient may select to indicate a desire to maintain the value of the corresponding parameter. The stay control may take the form of a stay button 724, such as the button shown on FIG. 12. The stay control may take other forms, such as a knob or slider control, which may be a physical device or part of a graphical user interface. The adjustment confirmation screen 720 also includes a decrease control that the patient may select to indicate a desire to decrease the value of the corresponding parameter. The decrease control may take the form of a decrease button 726 such as the button shown on FIG. 12. The decrease control may take other forms, such as a knob or slider control, which may be a physical device or part of a graphical user interface. For example, if the patient experiences pain or discomfort with the initial position, he or she may change the position using the decrease button 726 until the pain or discomfort is alleviated.

In some embodiments, one or more of the increase, the decrease, and/or the stay control(s) may be provided by one or more of the sensors 76, 84, 86. For example, the patient interface 50 may prompt the patient to move a body part until they start to feel discomfort, the system 10 may use one or more of the sensors 76, 84, 86 to measure the range of motion that the body part moved, and that range of motion may be used for performing the rehabilitation regimen. In another example, one or more of the sensors 76, 84, 86, such as a pressure sensor 76 and/or a goniometer 84, may measure a physical response by the patient, such as a flinch that indicates pain. A target value of the parameter may be set based upon the value of the parameter where the patient indicated pain or discomfort. That target value of the parameter may then be used for performing the rehabilitation regimen. The target value of the parameter may be set based upon a value of the parameter where the patient indicated pain or discomfort. The target parameter value may be set to X % of P, where X is a predetermined percentage, and P is the value of the parameter where the patient indicated pain or discomfort. For example, if a patient indicated pain at a pedal radius of 6.0 cm, and X is 90%, the target parameter value for the pedal position may be set to 5.4 cm, or 90% of 6.0 cm. Alternatively, the target parameter value may be set using an offset value that is added or subtracted from the value of the parameter where the patient indicated pain or discomfort. For example, if a patient indicated pain at pedal radius of 8.0 cm, and the offset value is −1.2 cm, then the target parameter value for the pedal radius may be set to 6.8 cm. Values of other parameters, such as target pressure or target speed, may be similarly adjusted.

In some embodiments, the system 10 may be configured to persuasively motivate the patient to use one or more settings for the position of the body part and/or the force exerted by the body part. For example, the patient interface 50 may show a target value or a target range for the position of the body part and/or the force exerted by the body part. In another example, the patient interface 50 may periodically encourage the patient to increase a setting for the position of the body part and/or the force exerted by the body part, particularly where that setting is below a target value or a target range. The system 10 may gradually increase a setting for the position of the body part and/or the force exerted by the body part while the patient is using the body part to perform the rehabilitation regimen. In some embodiments, the adjustment confirmation control may be presented to the patient only after the setting for the position of the body part and/or the force exerted by the body part has been actively used in performing the rehabilitation regimen for some period of time. In some embodiments, the adjustment confirmation control may not be presented to the patient, even after the setting for the position of the body part and/or the force exerted by the body part is adjusted.

In some embodiments, the patient interface 50 may present the adjustment confirmation control before the patient performs the rehabilitation regimen. Such a pre-performance adjustment allows the patient to use a confirmed or adjusted position and/or force setting while performing the rehabilitation regimen. Additionally or alternatively, the patient interface 50 may present the adjustment confirmation control during and/or after the rehabilitation regimen. For example, the adjustment confirmation screen 720 may be presented to the patient during a session or between sessions of the rehabilitation regimen. In some embodiments, the adjustment confirmation control may be presented in response to a triggering event. The triggering event may include, for example, the patient reporting pain in excess of a given value, or an inability to complete one or more activities within the treatment plan 154, or a sudden decrease in walking performed by the patient. Additionally or alternatively, the adjustment confirmation screen 720 may be presented to the patient after the patient has completed a session of the rehabilitation regimen. Such a post-session confirmation may be used to determine the patient's comfort, which may be a proxy for satisfaction with the session of the rehabilitation regimen. The post-session confirmation may be used to determine one or more settings for use in subsequent sessions. For example, an indication of "stay" or "increase" may cause a target value for position and/or pressure of the body part to be increased in subsequent sessions of the rehabilitation regimen.

Figure 13:
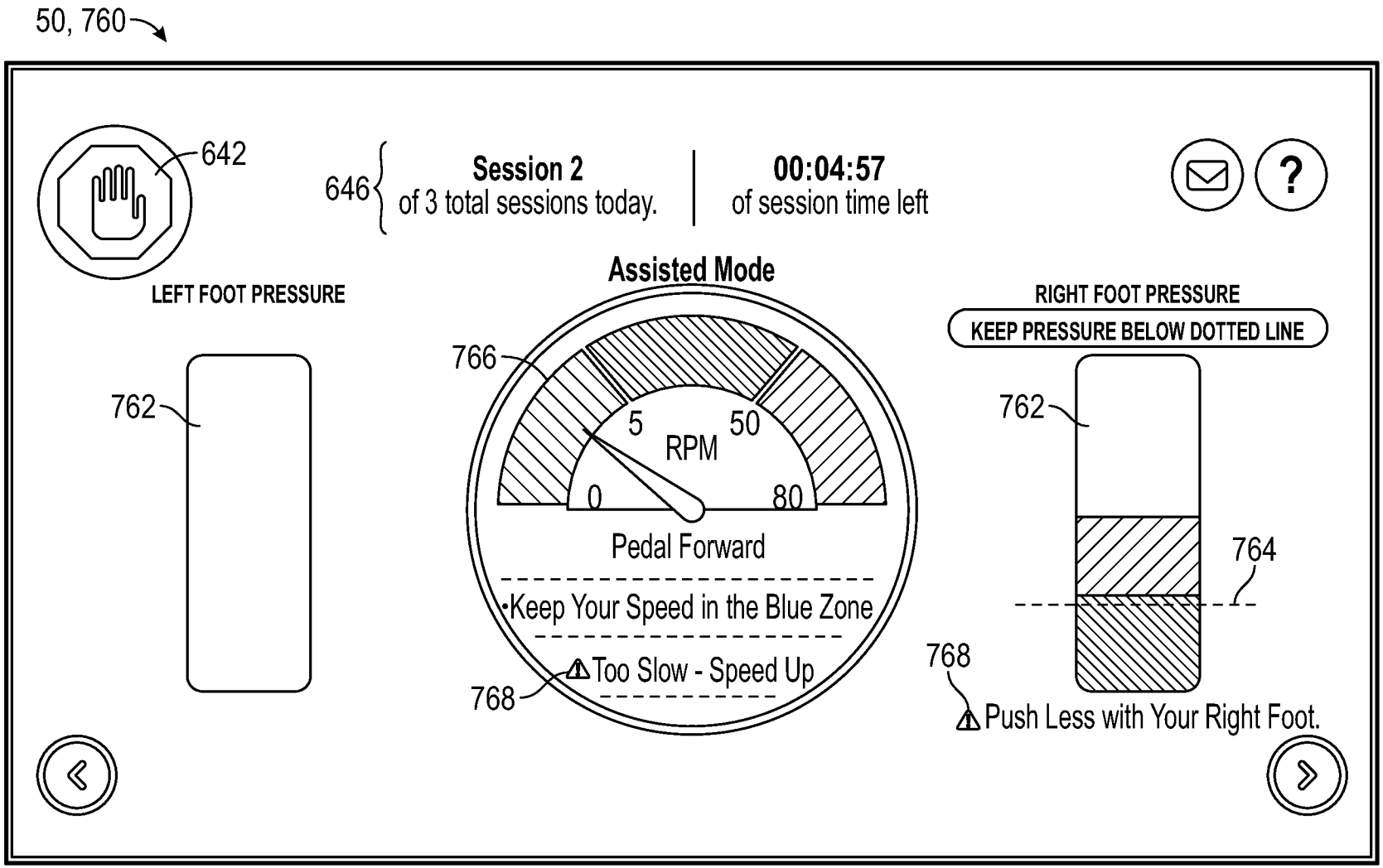
FIG. 13 shows an example embodiment of a session period action screen of a patient interface.

FIG. 13 shows an example embodiment of a session period action screen 760 of the patient interface 50. This screen 760 is displayed while a given session period is in progress. It includes one or more indicators showing real-time status of measurements regarding the patient's use of the treatment apparatus 70 to perform the rehabilitation regimen upon patient's body part. The measurements displayed may include, for example, a position of, and/or a force exerted by, the patient's body part. The example session period action screen 760 of FIG. 13 includes pressure indicators 762 showing an amount of pressure or force applied by each foot. The pressure indicators 762 show the pressures of the patient's feet upon the pedals 106 as measured by the pressure sensors 86. The pressure indicators 762 are shown as bar graphs, but other types of displays may be used, such as rotary gauges and/or numeric indicators. The pressure indicators 762 may also include a target pressure indicator 764 representing a target setting such as a target pressure value. The target setting may be determined by the clinician using an associated session parameter control 178 on the protocol management display 170, as shown, for example, on FIG. 8. The target setting may be set or adjusted via the adjustment confirmation control, by the patient.

In some embodiments, the clinician interface 20 may present information regarding the position of the body part and/or the force exerted by the body part. This information may include actual and/or target positions and/or forces as measured by one or more of the sensors 76, 84, 86. Additionally or alternatively, the information regarding the position of the body part and/or the force exerted by the body part may include a target value or a target range of values for either or both of the position of the body part and/or the force exerted by the body part. For example, the clinician interface 20 may provide a control for the clinician to adjust a value or a range of values as a target for a parameter such as a position, a force, or a speed used in a session or a session period or for a particular exercise within the rehabilitation regimen. Similarly, the clinician interface 20 may provide a control for the clinician to adjust minimum and/or maximum values for the parameter. For example, the patient may adjust the value of a pedal radius parameter from the preset target value up to the maximum value for that parameter, where the preset target value and the maximum value are both set by the clinician using corresponding controls on the clinician interface 20.

The session period action screen 760 also includes a speed indicator 766 showing a speed that the pedals 106 are turning, as measured by an internal sensor 76 of the stationary cycling machine 100. The speed indicator 766 is shown as a rotary gauge, but other types of displays may be used, such as a bar graph and/or a numeric indicator. The speed indicator 766 includes an optimal or desired speed range, which may be determined by the clinician using an associated session parameter control 178 on the protocol management display 170, as shown, for example, on FIG. 8. The session period action screen 760 may present prompts or messages 768 to enable the user to change the pressure and/or speed if either of those parameters is outside of a predetermined range.

Figure 14:
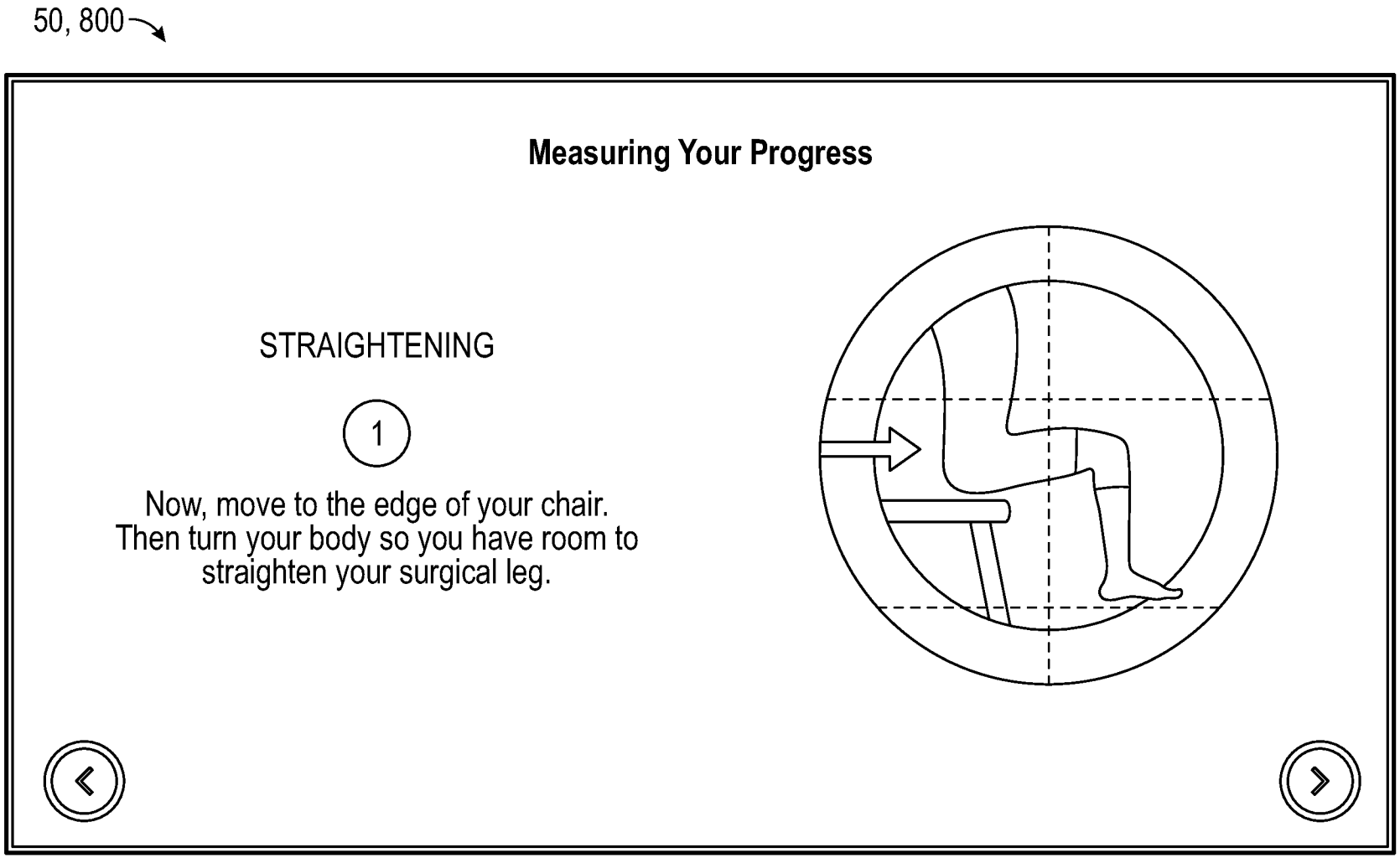
FIG. 14 shows an example embodiment of an exercise introduction screen of a patient interface.
Figure 15:
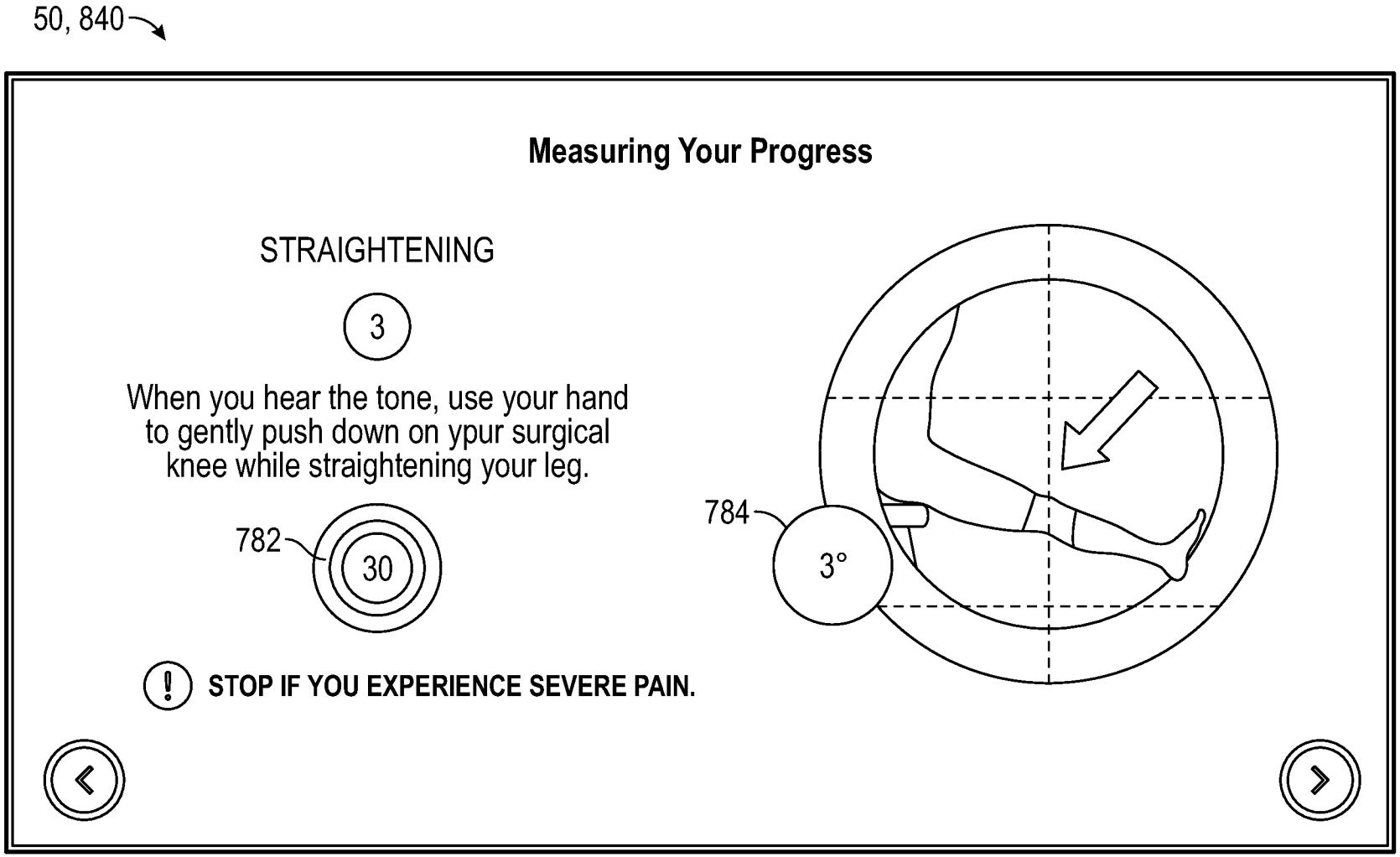
FIG. 15 shows an example embodiment of an exercise action screen of a patient interface.

FIG. 14 shows an example embodiment of an exercise introduction screen 800 of the patient interface 50. The exercise introduction screen 800 includes instructions and/or prompts for the patient to perform an exercise that is not performed using the treatment apparatus 70. In the example shown on FIG. 14, the exercise involves straightening the patient's leg. FIG. 15 shows an example embodiment of an exercise action screen 840 of the patient interface 50. The exercise action screen 840 includes a countdown timer 842 showing an amount of time that the patient should continue with a given exercise. The exercise action screen 840 also includes an angle display 844 showing an angle of a body part being exercised. The angle display 844 may show, for example, a knee flex angle measured by the goniometer 84 that is attached to the patient's knee.

Figure 16:
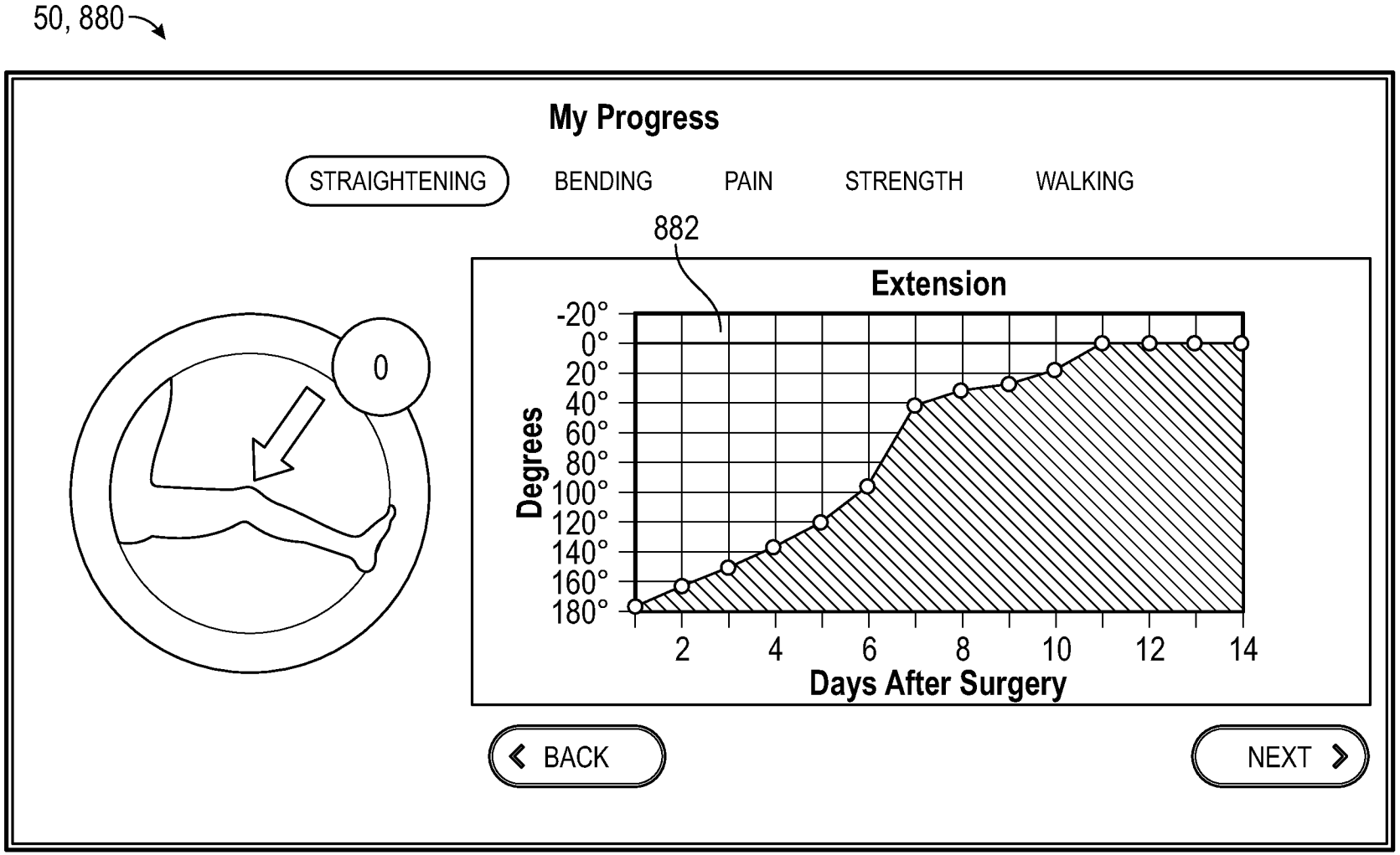
FIG. 16 shows an example embodiment of a first progress data screen of a patient interface.

FIG. 16 shows an example progress data screen 880 of the patient interface 50. The progress data screen 880 presents a progress graph 882 for each of several different parameters related to the treatment plan 154. For example, the progress graphs 882 may include historical data for straightening and bending of the knee pain, strength (lbs. pressure), and walking (steps per day). The progress graphs 882 may show identical data or data similar to what is presented on the treatment parameter graphs 136 of the clinician interface 20.

In some embodiments, a computer, such as the server 30, is configured to automatically modify the treatment plan 154 in response to satisfaction by the patient of a predetermined condition. For example, the treatment plan 154 may be limited in speed, velocity, or pressure settings or number of sessions per day until a predetermined condition is satisfied. In another example, the treatment plan 154 may include only certain types of session periods, such as passive type exercises, until the predetermined condition is satisfied. The predetermined condition may include, for example, a successful post-operative checkup; or completion of a predetermined number of sessions or satisfying a performance benchmark within the treatment plan. Such a benchmark may include, for example, walking X number of steps in a day, or some given RPM speed or a given number of pounds of force using the treatment apparatus 70. In some embodiments, the computer is configured to increase at least one of a frequency, a duration, or an intensity of an aspect of the treatment plan 154 in response to performance or occurrence of the predetermined condition. In some embodiments, the computer is configured to decrease at least one of a frequency, a duration, or an intensity of an aspect of the treatment plan 154 in response to a performance or occurrence of the condition. The predetermined condition may include, for example, the patient reporting pain in excess of a given value, or an inability to complete one or more activities within the treatment plan 154, or a sudden decrease in walking performed by the patient.

In some embodiments, the patient interface 50 may provide a prompt to the patient in response to occurrence of the predetermined condition. For example, in a session period where the patient is expected to maintain the stationary cycling machine at a speed of between 40 and 50 RPM, the predetermined condition may include the cycling machine operating below 30 RPM for a period of 5 seconds. In that case, the patient interface 50 may provide a prompt asking the patient if they are having trouble or pain in performing the activity. The prompts may narrow down a problem. For example, if the patient is unable to perform a given activity, then a computer, such as the server 30, may automatically modify the treatment plan 154 to include activities that are easier for the patient to complete, such as only passive or only assisted session periods. Alternatively, the treatment plan 154 may be suspended until the clinician or another qualified person, such as an orthopedic surgeon, directs the system 10 to re-enable the treatment plan 154. Additionally or alternatively, the patient's responses to the prompts may generate an alert to the clinician.

In some embodiments, the system may communicate an alert message to the clinician using a communication message, such as a pager message or a text message or an email. The alert message may include pseudonymized data and/or anonymized data or use any privacy enhancing technology to prevent confidential patient data from being communicated in a way that could violate patient confidentiality requirements. Such privacy enhancing technologies may enable compliance with laws, regulations, or other rules of governance such as, but not limited to, the Health Insurance Portability and Accountability Act (HIPAA), or the General Data Protection Regulation (GDPR), wherein the patient may be deemed a "data subject". For example, an alert message may direct the clinician that a particular type of alert exists, such as a patient reporting wound splitting, without identifying which patient made the report. The alert message may direct the clinician to check the clinician interface 20 for more specific details regarding the alert.

According to further aspects, the computer-implemented system 10 may be configured to automatically modify one or more parameters of the treatment plan based upon progress made by the patient in performing the treatment plan. For example, the server 30 may be configured to adjust one or more settings, such as frequency of sessions, a range of motion setting, and/or a pressure setting based on how the patient is progressing in the treatment plan. In some embodiments, the parameters available to be modified by the system may be adjusted within a corresponding range of values set by the clinician. For example, the clinician interface 20 may present one or more controls for the clinician to set a range of values that the system can use for each of the adjustable parameters. The system 10 may use an algorithm to add more sessions (e.g., if the patient is behind schedule). Alternatively, the system 10 may accelerate ahead to more difficult sessions if the recovery is proceeding faster than expected.

Figure 17:
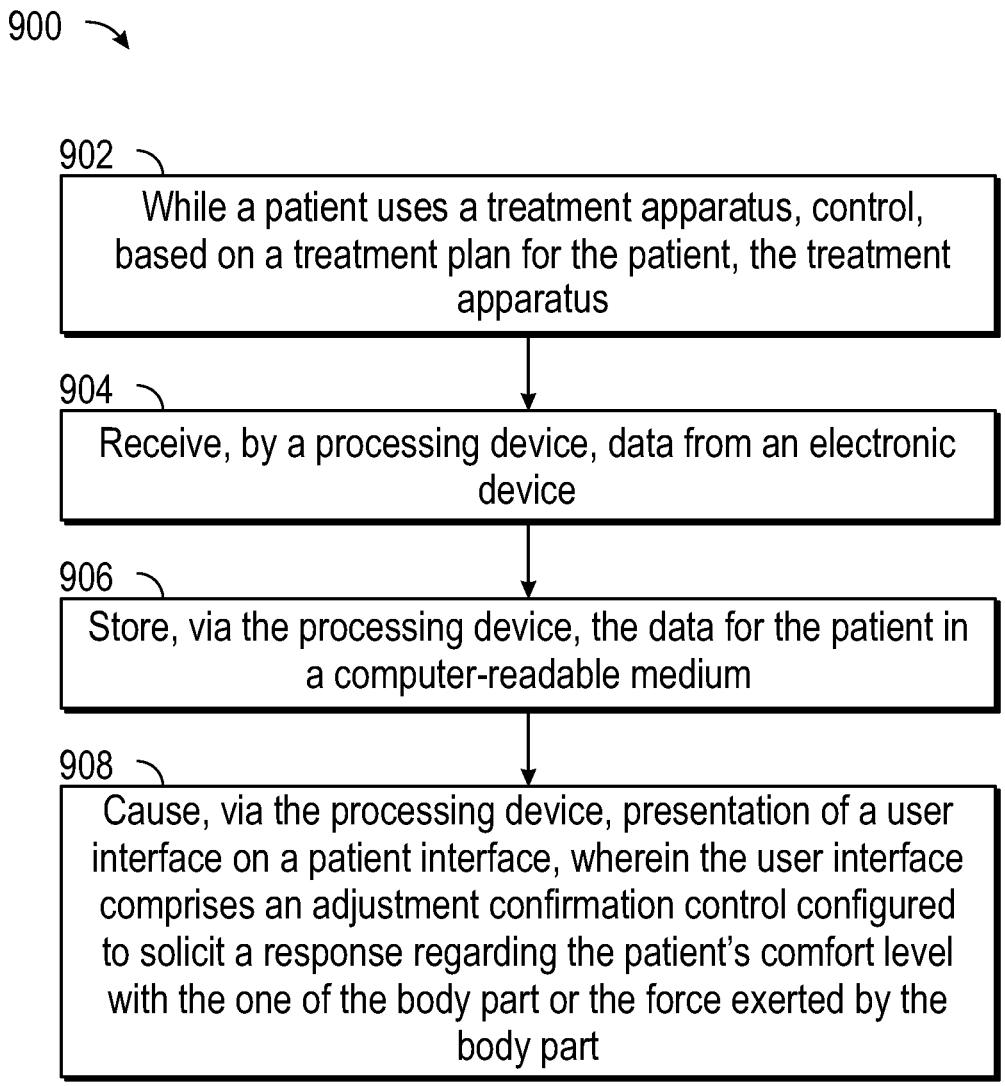
FIG. 17 shows an example method for persuasively motivating a patient to use a treatment apparatus.

FIG. 17 shows an example method 1700 for persuasively motivating a patient to use a treatment apparatus 70. The method 1700 is performed by processing logic that may include hardware (circuitry, dedicated logic, etc.), software (such as is run on a general-purpose computer system or a dedicated machine), or a combination of both. The method 1700 and/or each of its individual functions, routines, other methods, scripts, subroutines, or operations may be performed by one or more processors of a computing device (e.g., any component referenced in any of the FIGS., such as interfaces, servers, treatment apparatuses, sensors, etc.). In certain implementations, the method 1700 may be performed by a single processing thread. Alternatively, the method 1700 may be performed by two or more processing threads, each thread implementing one or more individual functions or routines; or other methods, scripts, subroutines, or operations of the methods.

For simplicity of explanation, the method 1700 is depicted and described as a series of operations. However, operations in accordance with this disclosure can occur in various orders and/or concurrently, and/or with other operations not presented and described herein. For example, the operations depicted in the method 1700 may occur in combination with any other operation of any other method disclosed herein. Furthermore, not all illustrated operations may be required to implement the method 1700 in accordance with the disclosed subject matter. In addition, those skilled in the art will understand and appreciate that the method 1700 could alternatively be represented as a series of interrelated states via a state diagram, a directed graph, a deterministic finite state automaton, a non-deterministic finite state automaton, a Bayesian model, a Markov diagram, or an event diagram.

At 1702, while the patient uses a treatment apparatus 70, the processing device may control, based on a treatment plan for a patient, the treatment apparatus 70. In some embodiments, the processing device may be separate from the treatment apparatus 70. For example, the processing device may be included in the patient interface, in a server, in the clinician interface, in any other interface discussed herein, in a sensor, in a computing device, or the like. In some embodiments, the processing device may be included in the treatment apparatus 70. In some embodiments, the treatment plan is a physical rehabilitation regimen for improving strength or range of motion of a body part.

At 1704, the processing device may receive data from an electronic device (e.g., patient interface, computing device of an individual (patient, clinician, staff member, nurse, etc.), clinician interface, sensor internal or external to the treatment apparatus 70, or any some combination thereof). The data may include one of a position of a body part of the patient or a force exerted by the body part. The data may include a measurement (e.g., pressure measurement from a sensor in a pedal of the treatment apparatus, speed of a motor operating within the treatment apparatus 70, range of motion (of a limb of the patient) received from a goniometer, etc.) pertaining to performance of a treatment plan by a patient using the treatment apparatus 70, a characteristic (e.g., a heartrate, a blood pressure, a percentage or other measurement of blood oxygen, a glucose level, a temperature, a perspiration rate, a pain level, etc.) pertaining to the patient, or both. In some embodiments, the body part is a joint, and the position of the body part comprises an angle of the joint. In some embodiments, the body part may include at least one of a joint, a bone, or a muscle group.

At 1706, the processing device may store the data for the patient in a computer-readable medium. At 1708, the processing device may cause a user interface to be presented on a patient interface. The user interface may include an adjustment confirmation control configured to solicit a response regarding the patient's comfort level with the one of the position of the body part or the force exerted by the body part. In some embodiments, the adjustment confirmation control may be configured to solicit the response regarding the patient's comfort level with the force exerted by the body part. In some embodiments, the adjustment confirmation control may be configured to solicit the response regarding the patient's comfort level with the position of the body part. In some embodiments, the processing device may cause presentation of a user interface on a clinician interface, wherein the user interface comprises information regarding the one of the position of the body part or the force exerted by the body part. Causing a user interface to be presented on any computing device may include transmitting data and/or computer instructions to the computing device. The computing device may use the data and/or execute the instructions to present the user interface on a display screen. The user interface may be included in a standalone application executing on the computing device and/or in an application (website) executing within another application (web browser).

Clauses:

1. A method comprising:

while the a patient uses a treatment apparatus, controlling, based on a treatment plan for the patient, the treatment apparatus;

receiving, by a processing device, data from an electronic device, wherein the data comprises one of a position of a body part of the patient or a force exerted by the body part;

storing, via the processing device, the data for the patient in a computer-readable medium;

causing, via a processing device, presentation of a user interface on a patient interface, wherein the user interface comprises an adjustment confirmation control, and the adjustment confirmation control is configured to solicit a response regarding the patient's comfort level with the one of the position of the body part or the force exerted by the body part.

2. The method of clause 1, wherein the processing device is separate from the treatment apparatus, and the method further comprises using the processing device separate from the treatment apparatus to perform the controlling of the treatment apparatus.

3. The method of clause 1, wherein the treatment plan is a physical rehabilitation regimen for improving strength or range of motion of the body part.

4. The method of clause 1, wherein the adjustment confirmation control is configured to solicit the response regarding the patient's comfort level with the force exerted by the body part.

5. The method of clause 1, wherein the adjustment confirmation control is configured to solicit the response regarding the patient's comfort level with the position of the body part.

6. The method of clause 5, wherein the body part is a joint, and the position of the body part comprises an angle of the joint.

7. The method of clause 1, further comprising causing, via the processing device, presentation of a user interface on a clinician interface, wherein the user interface comprises information regarding the one of the position of the body part or the force exerted by the body part.

8. A computer-implemented system for physical rehabilitation, comprising:

a clinician interface comprising a patient profile display, wherein the patient profile display is configured to present data regarding performance, by a patient, of a regimen for a body part, the body part comprising at least one of a joint, a bone, or a muscle group;

a sensor configured to measure one of a position of the body part or a force exerted by the body part;

a patient interface including an output device and an input device configured to communicate information respectively to and from the patient regarding the performance of the regimen;

the patient interface configured to present instructions and status information regarding the performance of the regimen; and the patient interface configured to present an adjustment confirmation control, wherein the adjustment confirmation control is configured to solicit a response regarding the patient's comfort level with the one of the position of the body part or the force exerted by the body part.

9. The computer-implemented system of clause 8, wherein the regimen is a physical rehabilitation regimen for improving strength or range of motion of the body part.

10. The computer-implemented system of clause 8, wherein the adjustment confirmation control is configured to solicit the response associated with the patient's comfort level with the force exerted by the body part.

11. The computer-implemented system of clause 8, wherein the adjustment confirmation control is configured to solicit the response associated with the patient's comfort level with the position of the body part.

12. The computer-implemented system of clause 11, wherein the body part is a joint, and the position of the body part comprises an angle of the joint.

13. The computer-implemented system of clause 8, wherein the clinician interface is configured to present information regarding the one of the position of the body part or the force exerted by the body part.

14. The computer-implemented system of clause 8, wherein the adjustment confirmation control provides an ICON configured to increase the one of the position of the body part or the force exerted by the body part during the regimen.

15. The computer-implemented system of clause 8, wherein the adjustment confirmation control provides a DCON configured to decrease the one of the position of the body part or the force exerted by the body part during the regimen.

16. The computer-implemented system of clause 8, wherein the adjustment confirmation control provides a SCON configured to maintain the one of the position of the body part or the force exerted by the body part during the regimen.

17. The computer-implemented system of clause 8, wherein the patient interface presents the adjustment confirmation control during or after the regimen.

18. The computer-implemented system of clause 8, further comprising, for performing the regimen, a treatment apparatus configured to be manipulated by the patient.

19. The computer-implemented system of clause 18, wherein the treatment apparatus comprises an actuator configured to adjust the position of the body part.

20. The computer-implemented system of clause 18, wherein the sensor is an internal sensor within the treatment apparatus.

21. A system for remote treatment, comprising:

a clinician interface configured to present controls for modifying a treatment plan comprising a regimen for treatment of a body part of a patient, with the body part comprising at least one of a joint, a bone, or a muscle group;

a treatment apparatus for performing the regimen upon the body part, the treatment apparatus configured to be manipulated by the patient;

a patient interface including an output device and an input device for communicating information respectively to and from the patient regarding the performance of the regimen;

wherein the patient interface and the treatment apparatus are each configured to enable operation from a patient location geographically separate from a location of the clinician interface; and the patient interface configured to present an adjustment confirmation control, wherein the adjustment confirmation control is configured to solicit a response regarding the patient's comfort level with one of a position of the body part or a force exerted by the body part.

22. The system of clause 21, wherein the treatment plan comprises a target setting for the one of the position of the body part or the force exerted by the body part.

23. The system of clause 21, wherein the regimen is a physical rehabilitation regimen for improving strength or range of motion of the body part.

24. The system of clause 21, wherein the adjustment confirmation control is configured to solicit the response regarding the patient's comfort level with the position of the body part.

25. The system of clause 24, wherein the body part is a joint, and the position of the body part comprises an angle of the joint.

26. A patient user interface generated by a computer and comprising:

a session period action screen configured to present real-time status of a measurement regarding a patient's use of a treatment apparatus for performing a regimen for a body part, the body part comprising at least one of a joint, a bone, or a muscle group;

an adjustment confirmation control configured to solicit a response regarding the patient's comfort level with one of a position of the body part or a force exerted by the body part; and wherein the measurement regarding the patient's use of the treatment apparatus includes the one of the position of the body part or the force exerted by the body part.

27. The patient user interface of clause 26, wherein the adjustment confirmation control provides an ICON configured to increase the one of the position of the body part or the force exerted by the body part during the regimen; and wherein the adjustment confirmation control provides a DCON configured to decrease the one of the position of the body part or the force exerted by the body part during the regimen.

28. The patient user interface of clause 26, wherein the adjustment confirmation control provides a SCON configured to maintain the one of the position of the body part or the force exerted by the body part during the regimen.

As will readily be appreciated by a person of ordinary skill of the art in light of having read the present disclosure, as used herein, actions described as being performed in real-time include actions performed in near-real-time without departing from the scope and intent of the present disclosure.

The various aspects, embodiments, implementations, or features of the described embodiments can be used separately or in any combination. The embodiments disclosed herein are modular in nature and can be used in conjunction with or coupled to other embodiments.

Consistent with the above disclosure, the examples of assemblies enumerated in the following clauses are specifically contemplated and are intended as a non-limiting set of examples.

What is claimed is:

1. A method comprising:

controlling, by a processing device, while a patient uses a treatment apparatus, the treatment apparatus, based on a treatment plan for the patient, the treatment plan comprising a target force setting value to be exerted by a body part of the patient, the treatment apparatus comprising an actuator configured to produce an external force based on the target force setting value;

causing, via the processing device, presentation of a first user interface on a patient interface, wherein the first user interface comprises an adjustment confirmation screen that solicits a response regarding the patient's comfort level with the target force setting value;

changing, based on the response, the target force setting value; and controlling the actuator to produce an external force based on the changed target force setting value.

2. The method of claim 1, wherein the processing device is separate from the treatment apparatus.

3. The method of claim 1, wherein the treatment plan is a physical rehabilitation regimen for improving strength.

4. The method of claim 1, further comprising causing, via the processing device, presentation of a second user interface on a clinician interface, wherein the second user interface comprises information regarding a force exerted by the body part of the patient.

5. The method of claim 1, wherein the adjustment confirmation screen comprises a decrease control configured to decrease the target force setting value.

6. The method of claim 1, wherein the adjustment confirmation screen comprises a stay control configured to maintain the target force setting value.

7. The method of claim 1, wherein the actuator is further configured to adjust a position of the body part of the patient.

8. A computer-implemented system for physical rehabilitation, comprising:

a clinician interface comprising a patient profile display, wherein the patient profile display is configured to present data regarding performance, by a patient using a treatment apparatus, of a regimen for a body part, wherein the regimen comprising a setting value of a target force to be exerted by the body part, the body part comprising at least one of a joint, a bone, or a muscle group, and the treatment apparatus comprising an actuator configured to produce an external force based on the setting value of the target force; and a patient interface configured to present an adjustment confirmation control screen, wherein the adjustment confirmation screen is configured to solicit a response regarding the patient's comfort level with the setting value of the target force, wherein, based on the response regarding the patient's comfort level with the setting value of the target force, the setting value of the target force is changed and the actuator is controlled to produce an external force based on the changed setting value of the target force.

9. The computer-implemented system of claim 8, wherein the regimen is a physical rehabilitation regimen for improving strength.

10. The computer-implemented system of claim 8, wherein the clinician interface is further configured to present information regarding a force exerted by the body part of the patient.

11. The computer-implemented system of claim 8, wherein the adjustment confirmation screen comprises an increase control configured to increase the setting value of the target force.

12. The computer-implemented system of claim 8, wherein the adjustment confirmation screen comprises a decrease control configured to decrease the setting value of the target force.

13. The computer-implemented system of claim 8, wherein the adjustment confirmation screen comprises a stay control configured to maintain the setting value of the target force.

14. The computer-implemented system of claim 8, wherein the actuator is further configured to adjust a position of the body part of the patient.

15. A system for remote treatment, comprising:

a clinician interface configured to present controls for modifying a treatment plan comprising a regimen for treatment of a body part of a patient, with the body part comprising at least one of a joint, a bone, or a muscle group, and the regimen comprising a setting value of a target force to be exerted by the body part; and a patient interface and a treatment apparatus each configured to enable operation from a patient location geographically separate from a location of the clinician interface, wherein the patient interface is configured to present an adjustment confirmation control screen, the adjustment confirmation control screen configured to solicit a response regarding the patient's comfort level with the setting value of the target force, and wherein, based on the response, the setting value of the target force is changed and an actuator of the treatment apparatus is controlled to produce an external force according to the changed setting value of the target force.

16. The system of claim 15, wherein the regimen is a physical rehabilitation regimen for improving strength.

17. The system of claim 15, wherein the clinician interface is further configured to present information regarding the force exerted by the body part of the patient.

18. The system of claim 15, wherein the adjustment confirmation screen comprises an increase control configured to increase the setting value of the target force.

19. The system of claim 15, wherein the adjustment confirmation screen comprises a decrease control configured to decrease the setting value of the target force.

20. The system of claim 15, wherein the adjustment confirmation screen comprises a stay control configured to maintain the setting value of the target force.

* * * * *